US008840206B2

(12) United States Patent
Hashimoto

(10) Patent No.: US 8,840,206 B2
(45) Date of Patent: Sep. 23, 2014

(54) NAIL PRINT APPARATUS AND PRINTING CONTROL METHOD

(75) Inventor: Shogo Hashimoto, Kawasaki (JP)

(73) Assignee: Casio Computer Co., Ltd., Tokyo (JP)

( * ) Notice: Subject to any disclaimer, the term of this patent is extended or adjusted under 35 U.S.C. 154(b) by 138 days.

(21) Appl. No.: 13/567,278

(22) Filed: Aug. 6, 2012

(65) Prior Publication Data

US 2013/0038647 A1 Feb. 14, 2013

(30) Foreign Application Priority Data

Aug. 10, 2011 (JP) ..... 2011-174650

(51) Int. Cl.

| | |
|---|---|
| ***B41J 3/00*** | (2006.01) |
| ***B41J 29/38*** | (2006.01) |
| ***B41J 29/02*** | (2006.01) |
| ***B41J 3/407*** | (2006.01) |
| ***B41J 11/00*** | (2006.01) |
| ***B41J 29/13*** | (2006.01) |
| *A45D 29/00* | (2006.01) |

(52) U.S. Cl.

CPC *B41J 3/407* (2013.01); *B41J 29/38* (2013.01); *B41J 29/02* (2013.01); *A45D 2029/005* (2013.01); *A45D 29/00* (2013.01); *B41J 11/008* (2013.01); *B41J 29/13* (2013.01)

USPC ..... 347/2; 347/106

(58) Field of Classification Search

CPC ..... A45D 2029/005

USPC ..... 347/2, 106

See application file for complete search history.

(56) References Cited

U.S. PATENT DOCUMENTS 6,286,517 B1 * 9/2001 Weber et al. ..... 132/73
6,336,694 B1 * 1/2002 Ishizaka ..... 347/2

FOREIGN PATENT DOCUMENTS

JP 2003-534083 A 11/2003

* cited by examiner

*Primary Examiner* — Manish S Shah
*Assistant Examiner* — Jeffrey C Morgan
(74) *Attorney, Agent, or Firm* — Holtz Holtz Goodman & Chick PC

(57) ABSTRACT

A nail print apparatus which prints on a nail and a printing control method of the nail print apparatus. In one implementation of the present invention, the nail print apparatus includes a imaging section; a nail region information detecting section which detects an outline and an area of the nail region; a print design image generating section; an element position judging section which judges whether or not a design element is contained within the nail region; and a printing section. The print design image generating section positions a design element in a position in the nail region which corresponds to a position on a standard nail model an element to a value in proportion with a ratio of the area of the nail region to an area of the standard nail model.

17 Claims, 32 Drawing Sheets

| DESIGN ELEMENT | dp1 | dp2 | dp3 | dp4 |
|---|---|---|---|---|
| SIZE(%) | 20 | 28 | 28 | 20 |
| POSITION: x-AXIS DIRECTION(%) | 50 | 5 | 80 | 45 |
| POSITION: y-AXIS DIRECTION(%) | 15 | 40 | 70 | 95 |
| IMAGE DATA(bmp) | FLOWER a | FLOWER a | FLOWER a | FLOWER a |

| DESIGN ELEMENT | dp1 | dp2 | dp3 |
|---|---|---|---|
| SIZE(%) | 30 | 27 | 34 |
| POSITION: x-AXIS DIRECTION(%) | 8 | 60 | 75 |
| POSITION: y-AXIS DIRECTION(%) | 70 | 90 | 12 |
| IMAGE DATA(bmp) | CHERRY BLOSSOM | CHERRY BLOSSOM | FLOWER b |

| | |
|---|---|
| AREA:S(dot) | 21593 |
| WIDTH:W<br>LENGTH IN HORIZONTAL DIRECTION(dot)<br>(x-AXIS DIRECTION) | 115 |
| HEIGHT<br>LENGTH IN VERTICAL DIRECTION(dot)<br>(y-AXIS DIRECTION) | 211 |

NAIL PRINT APPARATUS AND PRINTING CONTROL METHOD

CROSS-REFERENCE TO RELATED APPLICATIONS

This application is based upon and claims the benefit of priority from the prior Japanese Patent Application No. 2011-174650, filed Aug. 10, 2011, the entire contents of all of which are incorporated herein by reference.

BACKGROUND OF THE INVENTION

1. Field of the Invention

The present invention relates to a nail print apparatus and a printing control method. Specifically, the present invention relates to a nail print apparatus and a printing control method so that a printed design image is not printed outside a nail of the user.

2. Description of the Related Art

The nail print apparatus is a print apparatus in which a finger of a nail on which a design is printed is positioned on a finger placement stage provided in the apparatus main body and a design image such as color, pattern, etc. is printed on a nail of the positioned finger. In such nail print apparatuses, the user selects a design image which the user desires to print on the user's nail and prints the selected design image on the region of the nail section of the finger (hereinafter referred to as the "nail region").

Conventionally, the design image is stored in the storage section of the nail print apparatus, etc. as a piece of image data and the design image is printed on the nail by adjusting the scale of the entire image data according to the size, shape, etc. of the nail region of the user. Such nail print apparatus is described in, for example, Japanese Unexamined Patent Application Publication No. 2003-534083.

However, in a configuration where the scale of the entire image data of the design image is changed, each pattern included in the design image may be deformed, or the space between the pattern portion and the boundary of the nail region may be unnaturally too large or too small.

In this case, even if the design image is printed within the nail region, the impression of the design image selected by the user is different from the image actually printed on the nail region. Therefore, the desired design as imaged by the user may not be suitably printed.

Moreover, since the shape of the nail region is different according to each individual, by merely reducing the image data, a portion of each pattern may be printed outside the nail region or the image may be reduced too much so that it is not possible to print in an image of the user's impression when the image data is actually printed.

SUMMARY OF THE INVENTION

The present invention has been made in consideration of the above situation, and one of the main objects is to provide a nail print apparatus and a printing control method to print a design close to the impression of the design image selected by the user as large as possible automatically without printing outside of the nail region of the user.

In order to achieve any one of the above advantages, according to an aspect of the present invention, there is provided a nail print apparatus which prints on a nail including:

an imaging section which obtains a finger image by photographing a finger including the nail;

a nail region information detecting section which extracts a nail region corresponding to a surface of the nail from the finger image and detects a coordinate value of an outline of the nail region and an area of the nail region;

a print design image generating section which generates a print design image in which at least one design element is positioned in a region including the nail region based on a specific design image;

an element position judging section which judges whether or not the design element of the print design image is contained within the nail region; and a printing section which includes a printing head to apply ink to the nail based on the print design image, wherein, the design element is set in a certain figure;

the specific design image is an image which includes the design element positioned on a pre-set shaped standard nail model; and in the print design image, the print design image generating section positions the design element in a position corresponding to a layout position of the design element on the standard nail model in the specific design image and sets a size of the design element to a value in proportion with a ratio of the area of the nail region with respect to an area of the standard nail model.

According to another aspect of the present invention, there is provided a printing control method of a nail print apparatus which prints on a nail, the printing method including the steps of:

obtaining a finger image by taking a photograph of a finger including the nail;

extracting a nail region corresponding to a surface of the nail from the obtained finger image;

detecting a coordinate value of an outline of the nail region and an area of the nail region;

generating a print design image by positioning at least one design element set in a certain figure in a region including the nail region based on a specific design image which includes the design element positioned on a pre-set shaped standard nail model;

judging whether or not the design element of the print design image is contained within the nail region; and adjusting at least either one of the position of the print design image with respect to the nail region or the size of the print design image, until it is judged that the design element of the print design image is contained within the nail region, the step of generating the print design image includes positioning the design element in a position corresponding to a layout position of the design element on the standard nail model in the specific design image and setting a size of the design element to a value in proportion with a ratio of the area of the nail region with respect to an area of the standard nail model.

Additional advantages of the invention will be set forth in the description which follows, and in part will be obvious from the description, or may be learned by practice of the invention. The advantages of the invention may be realized and obtained by means of the instrumentalities and combinations particularly pointed out hereinafter.

BRIEF DESCRIPTION OF THE SEVERAL VIEWS OF THE DRAWINGS

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

The nail print apparatus and the printing control method of the present invention are described in detail by showing preferred embodiments.

Figure 1:
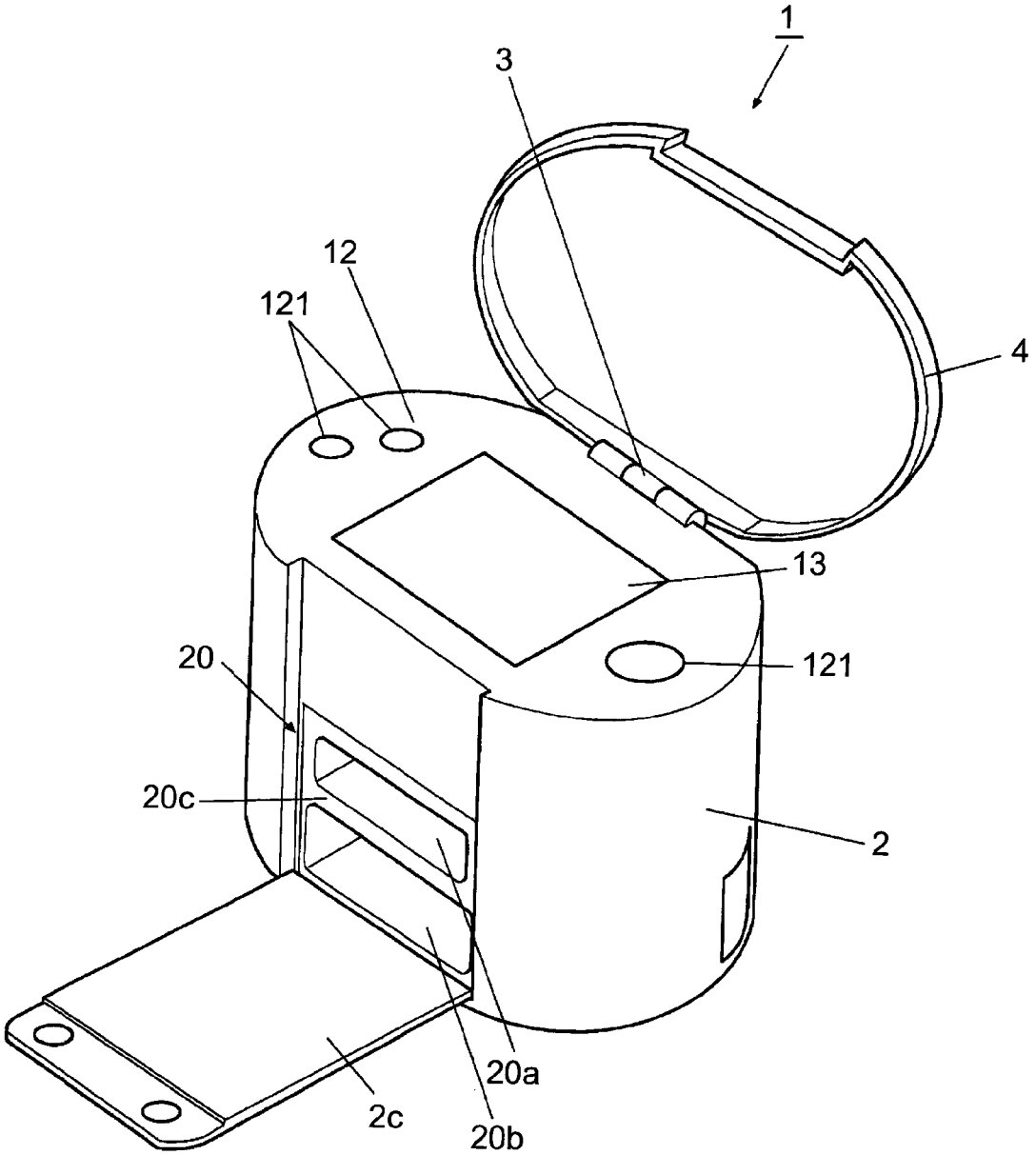
FIG. 1 is a perspective view showing an outer appearance of the nail print apparatus of an embodiment of the present invention.

FIG. 1 is a perspective view showing an outer appearance of the nail print apparatus of an embodiment of the present invention.

Figure 2:
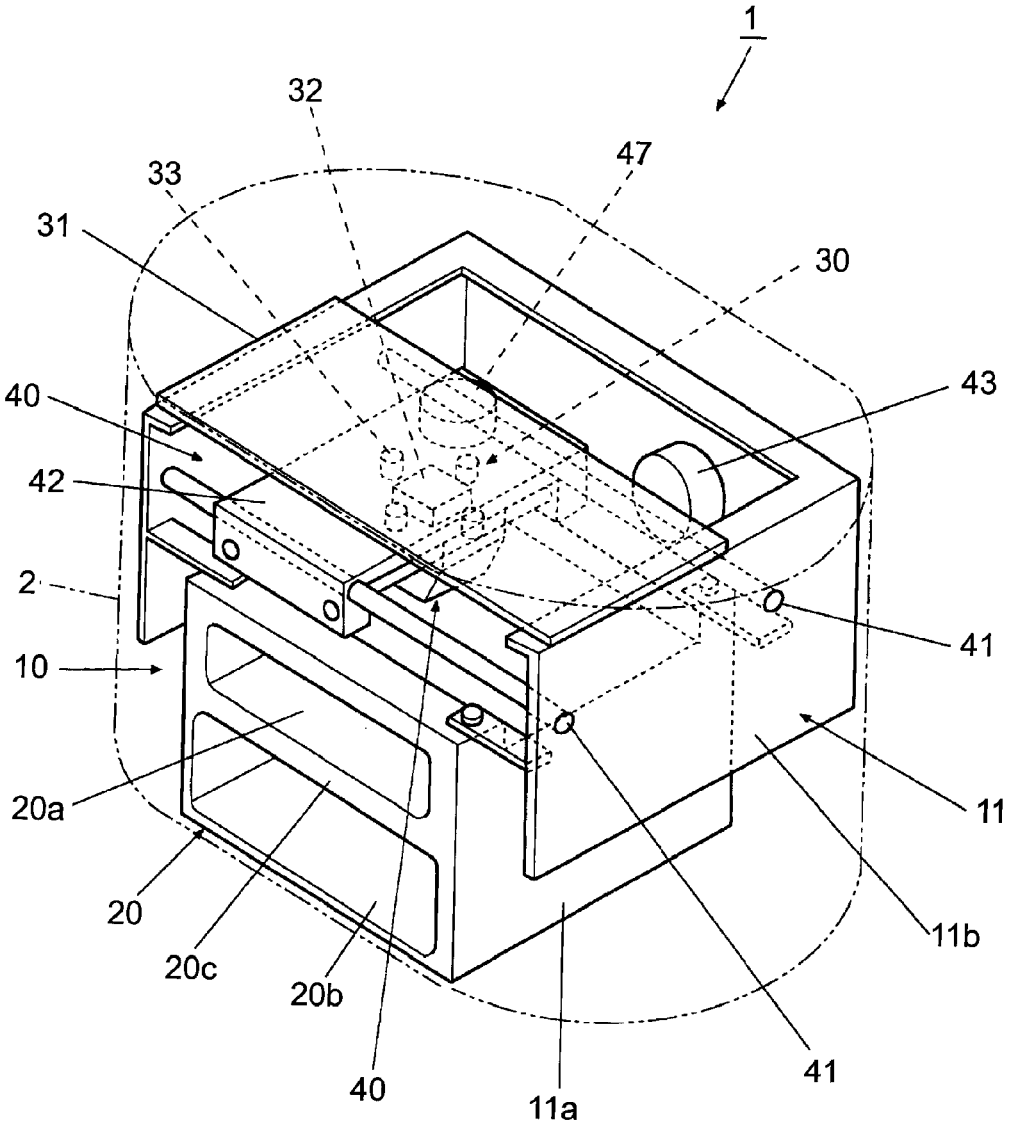
FIG. 2 is a perspective view showing an inner configuration of a nail print apparatus of the present embodiment.

FIG. 2 is a perspective view showing an inner configuration of a nail print apparatus of the present embodiment.

Figure 3:
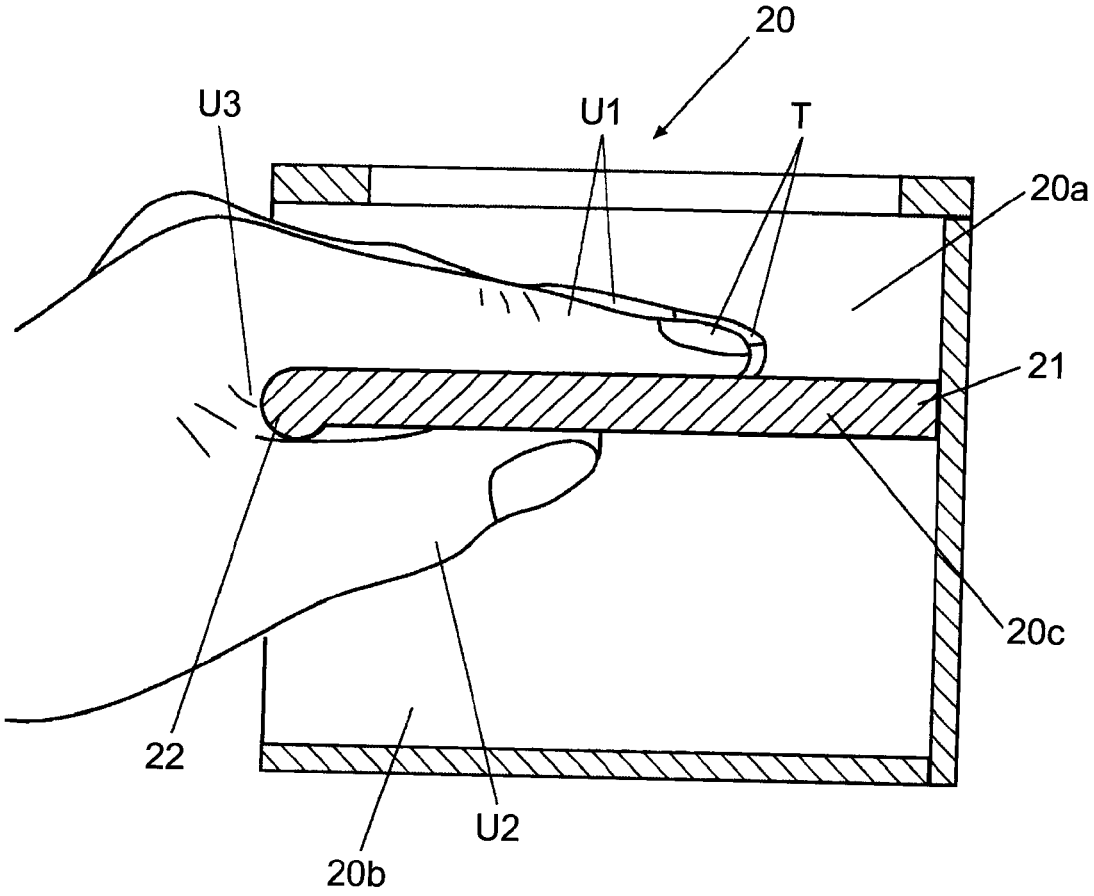
FIG. 3 is a cross sectional view showing a print finger fixing section of the nail print apparatus of the present embodiment, and shows a state of inserting an index finger to a little finger as a print finger in the print finger inserting section.

FIG. 3 is a cross sectional view showing a print finger fixing section of the nail print apparatus of the present embodiment, and shows a state of inserting an index finger to a little finger as a print finger in the print finger inserting section.

As shown in FIG. 1, the nail print apparatus 1 includes a case main body 2 and a cover 4. The case main body 2 and the cover 4 are connected to each other through a hinge 3 provided to an upper face rear edge section of the case main body 2.

The case main body 2 is formed in an oval shape from a planar view. An opening/closing plate 2*c* is provided to stand and lay down on the front side of the case main body 2. The opening/closing plate 2*c* is connected to the case main body 2 through a hinge provided on the front face lower edge section of the case main body 2. The opening/closing plate 2*c* is for opening and closing the front face of the case main body 2.

A later described operating section 12 is provided on a top plate 2*f* of the case main body 2 and a display section 13 is set at a substantial center section of the top plate 2*f*.

The shape and the configuration of the case main body 2 and the cover 4 are not limited to the illustrated examples.

The apparatus main body 10 of the nail print apparatus 1 is stored in the case main body 2.

Figure 8:
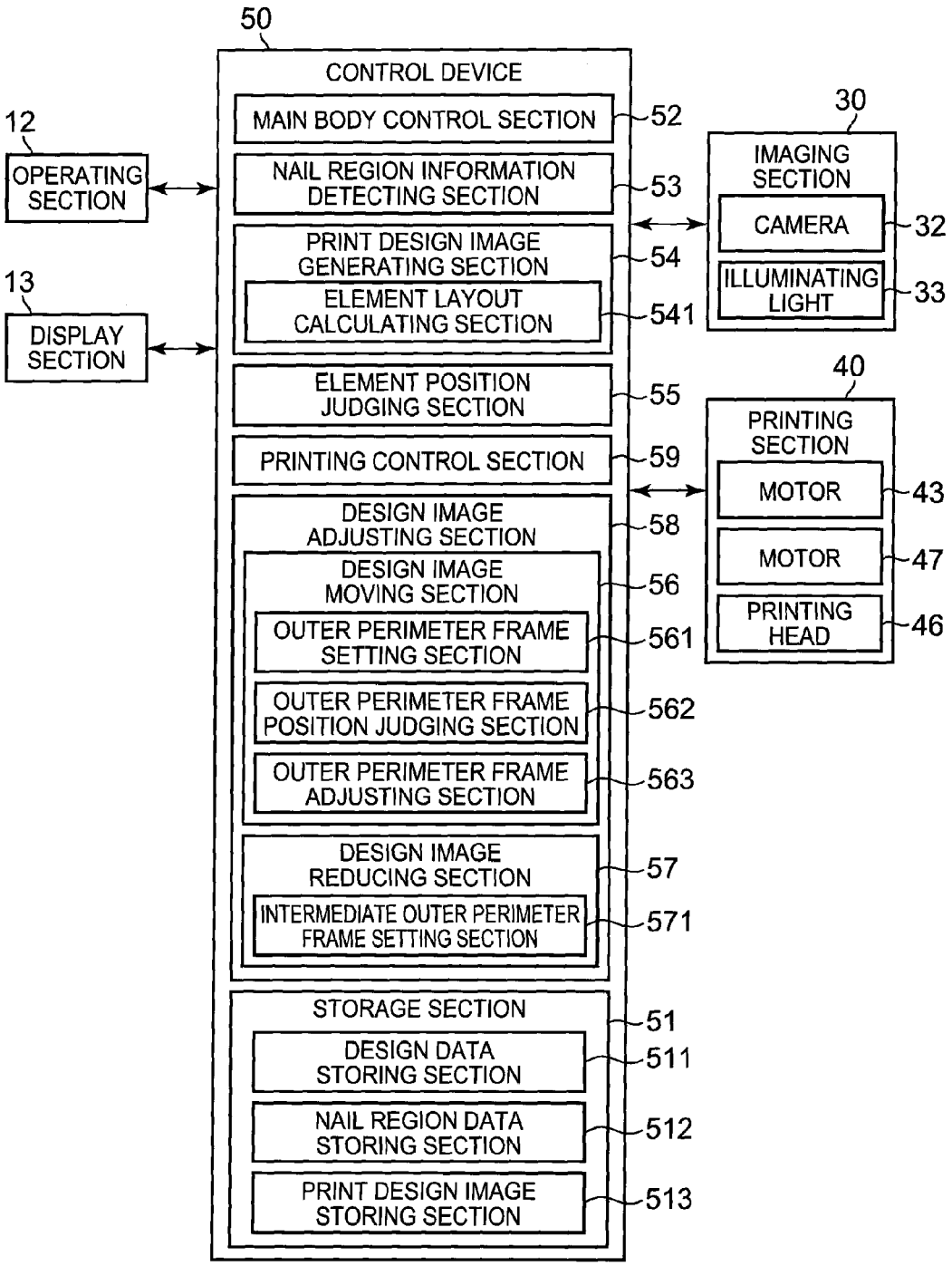
FIG. 8 is a main section block diagram showing a configuration of a control device in a nail print apparatus of the present embodiment.

As shown in FIG. 2, the apparatus main body 10 includes a print finger fixing section 20, an imaging section 30, a printing section 40, and a control device 50 (see FIG. 8).

The print finger fixing section 20, the imaging section 30, the printing section 40, and the control device 50 are provided in the device casing 11.

The device casing 11 is composed of a lower portion device casing 11*a* and an upper portion device casing 11*b*.

The lower portion device casing 11*a* is formed in a box shape and is provided in a lower portion inside the case main body 2. The upper portion device casing 11*b* is provided above the lower portion device casing 11*a* in an upper portion inside the case main body 2.

The print finger fixing section 20 is provided in the lower portion device casing 11*a* in the device casing 11.

The print finger fixing section 20 is composed of a print finger inserting section 20*a*, a non-print finger inserting section 20*b* and a holding section 20*c* provided in the lower portion device casing 11*a*.

The print finger inserting section 20*a* is a finger inserting section to insert a finger corresponding to a nail T to be printed (hereinafter referred to as "print finger") (see FIG. 3).

A base (print finger placement face) of the print finger inserting section 20*a* includes a function to place the print finger U1.

The photographing and printing of the print finger U1 are performed in a state where the print finger U1 is positioned on the print finger placement face of the print finger inserting section 20*a*.

The non-print finger inserting section 20*b* is a finger inserting section to insert the finger U2 other than the print finger (hereinafter referred to as "non-print finger") (see FIG. 3).

The holding section 20*c* can be held between the print finger U1 inserted in the print finger inserting section 20*a* and the non-print finger U2 inserted in the non-print finger inserting section 20*b*.

In the present embodiment, the holding section 20*c* includes a partition wall 21 which divides the print finger inserting section 20*a* and the non-print finger inserting section 20*b*.

The upper face of the partition wall 21 includes a flat print finger placement face.

A projecting section 22 is formed in an end section of the partition wall 21 on the side that the finger is inserted. The projecting section 22 is formed in a portion where a base U3 of the print finger U1 and the non-print finger U2 comes into contact with when the print finger U1 and the non-print finger U2 are inserted deeply in the print finger inserting section 20*a* and the non-print finger inserting section 20*b*. The projecting section 22 is formed so that the cross section in a finger inserting direction is for example, a circular shape projecting downward from a lower face of the partition wall 21. With this, in a state where the entire pulp of the print finger U1 is in contact with the print finger placement face, the projecting section 22 can be held with the base U3 of the print finger U1 and the non-print finger U2 to firmly hold the partition wall 21 (holding section 20*c*). The shape of the projecting section 22 is not limited to the cross section being a circular shape, and can be a cross section of an oval shape, or a noncircular shape such as a polygon, etc.

For example, when the four fingers (index finger, middle finger, ring finger, and little finger) other than the thumb of the left hand are the print fingers U1, as shown in FIG. 3, the user inserts the four print fingers U1 in the print finger inserting section 20*a* and inserts the thumb which is the non-print finger U2 in the non-print finger inserting section 20*b*. The user holds the holding section 20*c* between the print fingers U1 inserted in the print finger inserting section 20*a* and the non-print finger U2 inserted in the non-print finger inserting section 20*b* and the print fingers U1 are fixed on the holding section 20*c*.

When the print finger U1 is only the thumb, the user inserts the thumb (print finger U1) in the print finger inserting section 20*a* and inserts the four fingers other than the thumb (non-print fingers U2) in the non-print finger inserting section 20*b*. In this case also, the user holds the holding section 20*c* in between the print finger U1 and the non-print fingers U2 and the print finger U1 is fixed on the holding section 20*c*.

Figure 4:
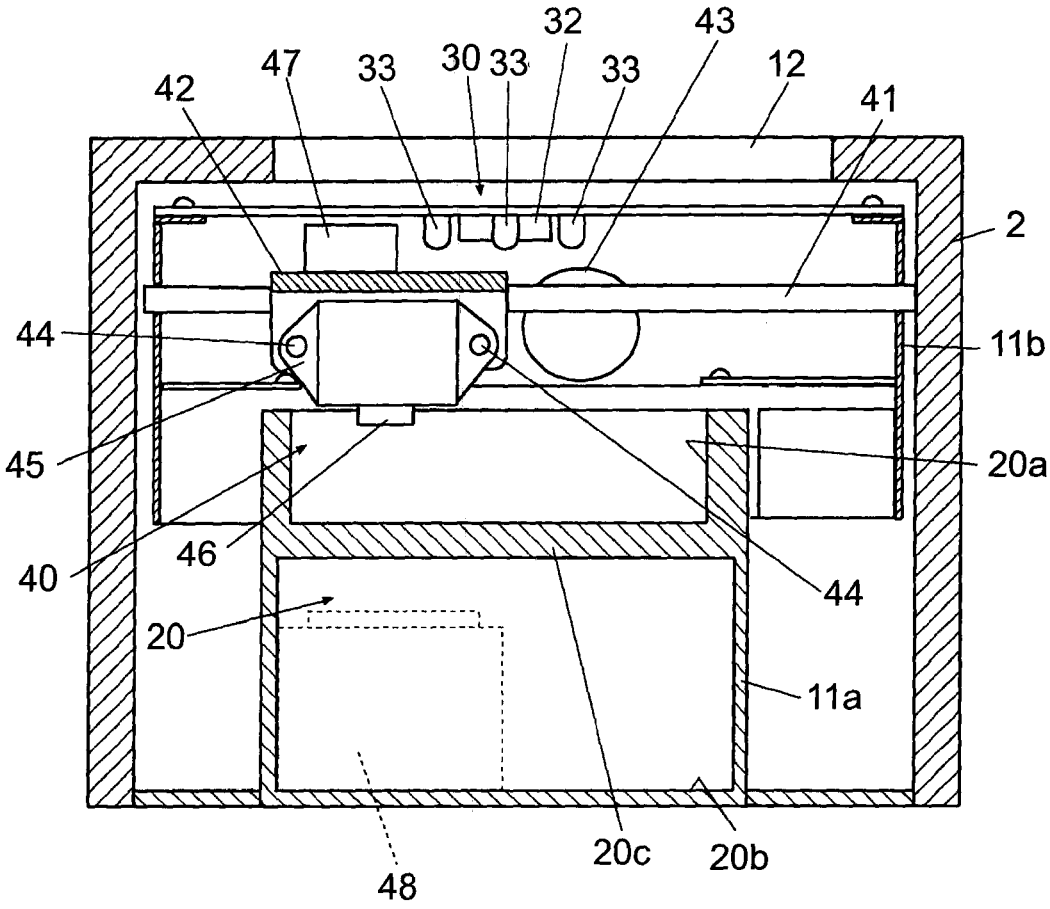
FIG. 4 is a cross sectional view of a front face side of the nail print apparatus of the present embodiment.

FIG. 4 is a cross sectional view of a front face side of the nail print apparatus of the present embodiment.

Figure 5:
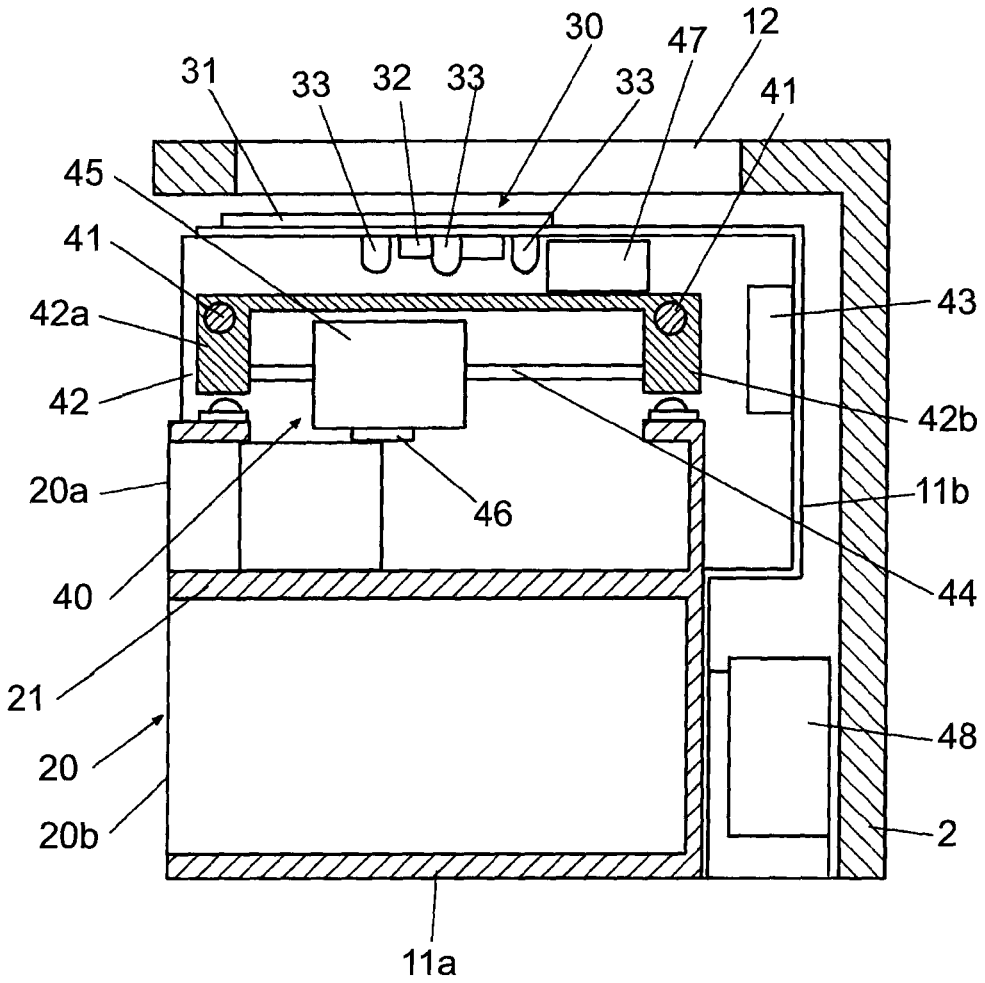
FIG. 5 is a cross sectional view of a side face side of the nail print apparatus of the present embodiment.

FIG. 5 is a cross sectional view of a side face side of the nail print apparatus of the present embodiment.

As shown in FIG. 4 and FIG. 5, the imaging section 30 is provided in the upper portion device casing lib in the device casing 11.

A camera 32 including a driver and pixels such as about 2 million pixels or more is provided on the lower face of the center section of a substrate 31 provided to the upper portion device casing 11*b*.

Illuminating lights 33 such as white color LED, etc. are provided on the substrate 31 so as to surround the camera 32. The imaging section 30 includes the camera 32 and the illuminating lights 33.

The imaging section 30 illuminates the print finger U1 positioned in the print finger inserting section 20*a* with the illuminating lights 33, photographs the print finger U1 with the camera 32 and obtains the finger image. The imaging section 30 is connected to a later described main body control section 52 of the control device 50. The main body control section 52 controls the imaging section 30.

The printing section 40 prints a color, a design, etc. on a nail region Ta (see FIG. 7, etc.) which is a print target region according to the print data based on the coordinate value of the nail region Ta.

In other words, as shown in FIG. 4 and FIG. 5, two guide rods 41 are provided in the left and right direction parallel to each other to bridge both side plates of the upper portion device casing 11*b*. The guide rods 41 are provided with a main carriage which can slide freely along the guide rods 41. Here, the left and right direction that the guide rods 41 are provided is a direction along the width direction of the holding section 20*c*. As shown in FIG. 5, two guide rods 44 are provided parallel to each other along a front and back direction orthogonal to the guide rods 41 to bridge a front wall 42*a* and a rear wall 42*b* of the main carriage 42. The guide rods 44 are provided with a sub-carriage 45 which can slide freely along the guide rods 44. A printing head 46 is mounted to the center section of the bottom face of the sub-carriage 45.

According to the present embodiment, the printing head 46 is a printing head of an ink-jet method which prints by forming the ink into small drops and directly spraying ink to the print target region to apply ink. The recording method of the printing head 46 is not limited to the ink jet method.

The main carriage 42 is connected to a motor 43 through a power transmission measure (not shown), and the main carriage 42 moves in a left and right direction along the guide rods 41 with the regular and reverse rotation of the motor 43.

The sub-carriage 45 is connected to a motor 47 through a power transmission measure (not shown), and the sub-carriage 45 moves in a front and rear direction along the guide rods 44 with the regular and reverse rotation of the motor 47.

The lower portion device casing 11*a* is provided with an ink cartridge 48 which supplies ink to the printing head 46. The ink cartridge 48 is connected to a printing head 46 through an ink supplying tube which is not shown and supplies ink to the printing head 46 as necessary. The ink cartridge can be mounted on the printing head 46 itself.

The printing section 40 includes the guide rods 41, the main carriage 42, the motor 43, the guide rod 44, the sub-carriage 45, the printing head 46, the motor 47, the ink cartridge 48 and the like.

The motor 43 of the printing section 40, the printing head 46, and the motor 47 are connected to the later described main body control section 52 of the control device 50 and the main body control section 52 controls the above components.

Figure 6:
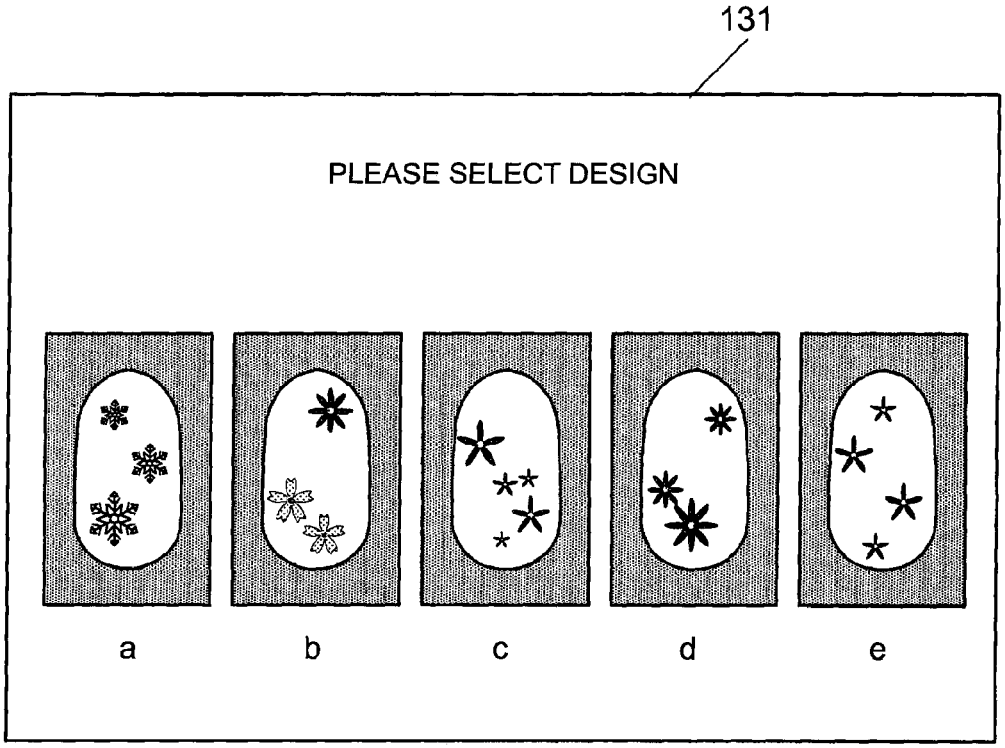
FIG. 6 is a diagram showing an example of a design selecting screen displayed on the display section.

FIG. 6 is a diagram showing an example of a design selecting screen displayed on the display section.

Figure 7:
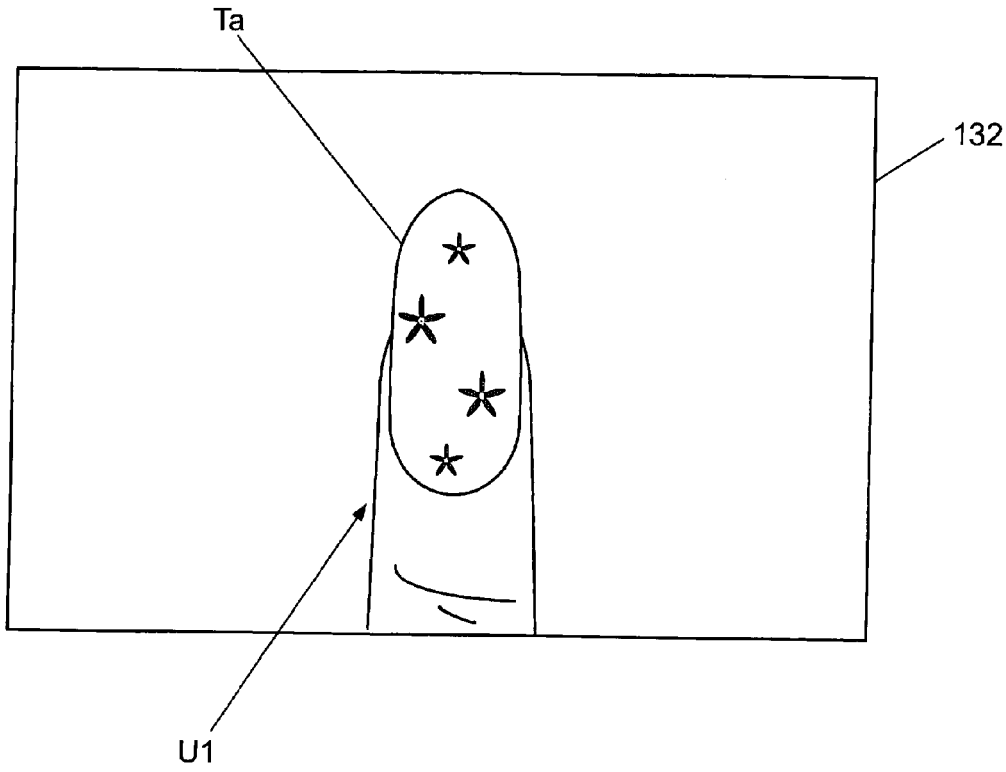
FIG. 7 is a diagram showing an example of a design confirming screen displayed on the display section.

FIG. 7 is a diagram showing an example of a design confirming screen displayed on the display section.

The operating section 12 is an input section for the user to perform various input.

The operating section 12 is provided with, for example, a power source switch button which turns the power source of the nail print apparatus 1 to ON, stop switch button which stops the operation, and operating buttons 121 to perform other various input.

According to the present embodiment, one of the operating buttons 121 includes a function as a design selecting section to select a design image from a plurality of design images stored in a later described design data storing section 511 of the storage section 51. In other words, when one of the operating buttons 121 is operated to function as the design selecting section, for example, a design selecting screen 131 as shown in FIG. 6 is displayed on the display section 13. Here, the user selects an alphabet corresponding to the desired design image with the operating button 121 to select the design image to be printed.

The display section 13 is composed of, for example, a liquid crystal panel (liquid crystal display (LCD)).

The display section 13 can be composed as one with a touch panel on the surface of the display section 13. In this case, various input can be performed by touching the surface of the display section 13 with touching operation by a stylus pen which is not shown, a finger tip or the like.

The display section 13 displays, for example, a finger image photographed by the print finger U1 and a nail region Ta of the finger image, a nail image pattern to be printed in the nail region Ta of the print finger U1, a thumbnail image for confirming the design, etc.

As described above, the display section 13 displays a design selecting screen 131 as shown in FIG. 6. According to the present embodiment, the design image can be selected from five types of design images which are design image a to design image e. The design images a to e are displayed aligned in the design selecting screen 131.

When a touch panel is added as one on the surface of the display section 13, the user can simply touch the desired design image to select the desired design image as the design image to be printed. In this case, the display section 13 also functions as the design selecting section.

The display section 13 displays the design confirming screen 132 as shown in FIG. 7. The design confirming screen 132 overlaps the design image selected by the user on the nail image Ta of the finger image of the user.

The design image displayed on the design confirming screen 132 is a design image in which the entire size, and printing size and printing position of each design element dp are adjusted by the later described control device 50 so as to match the nail region Ta of the user. The user can confirm the final printing image with the design confirming screen 132.

The user confirms the final design to be printed on the nail region Ta with the design confirming screen 132. When printing can be started as is, the operating button 121 is operated to instruct start (performing) of printing. When the user desires to change the design image, the user operates the operating button 121 to instruct change and it is possible to return to the design selecting screen 131 (see FIG. 6).

When the touch panel is added as one on the surface of the display section 13, the printing process of the design image can be started by the user touching the design confirming screen 132 or by the user touching the operating button 121 such as an OK button which can be displayed on the design confirming screen.

The control device 50 is provided on, for example the substrate 31 provided in the upper portion device casing 11*b*.

FIG. 8 is a main section block diagram showing a configuration of a control device in a nail print apparatus of the present embodiment.

The control device 50 is a computer provided with a storing section 51 including a CPU (Central Processing Unit), ROM (Read Only Memory), RAM (Random Access Memory), (all not shown) and the like.

The storage section 51 stores various programs such as a nail region extracting program which extracts a nail region, an element layout calculating program which calculates a printing size and a printing position of the design element, a print data generating program which generates printing data, a printing program which performs printing process and the like. The control device 50 performs the above programs as necessary and controls each section of the nail print apparatus 1.

In the present embodiment, a design data storing section 511 which stores data regarding the design image is provided in the storage section 51. The design data storing section 511 is a design image storing section which stores a plurality of groups of design images. Each design image includes a plurality of design elements dp and size data, position data and picture data are corresponded to each other for each design element dp.

Figures 9, 10:
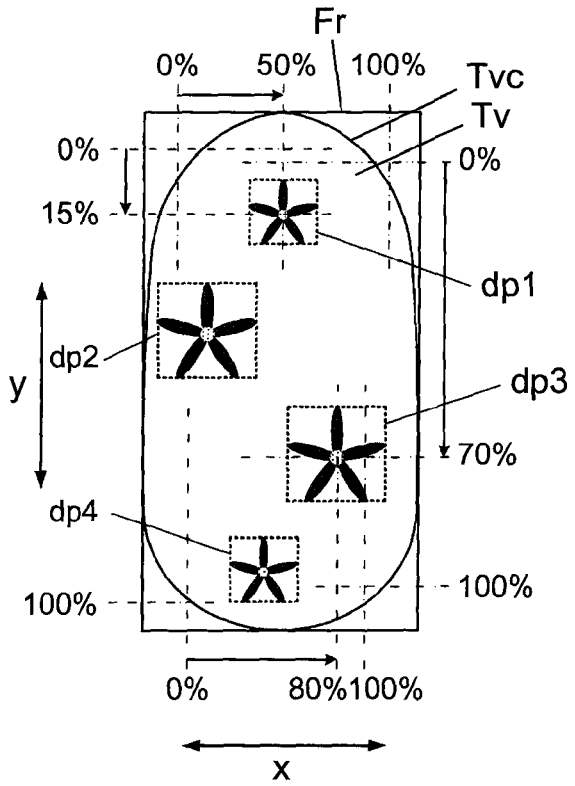
FIG. 9 is an explanatory diagram which describes an example of a configuration of a design image e.
FIG. 10 is a table showing an example of a configuration of data of the design image e.

FIG. 9 is an explanatory diagram showing an example of a configuration of a design image e shown in FIG. 6 where the design image e is positioned on the standard nail model.

FIG. 10 is a table showing an example of a configuration of data of the design image e shown in FIG. 9.

Figure 11:
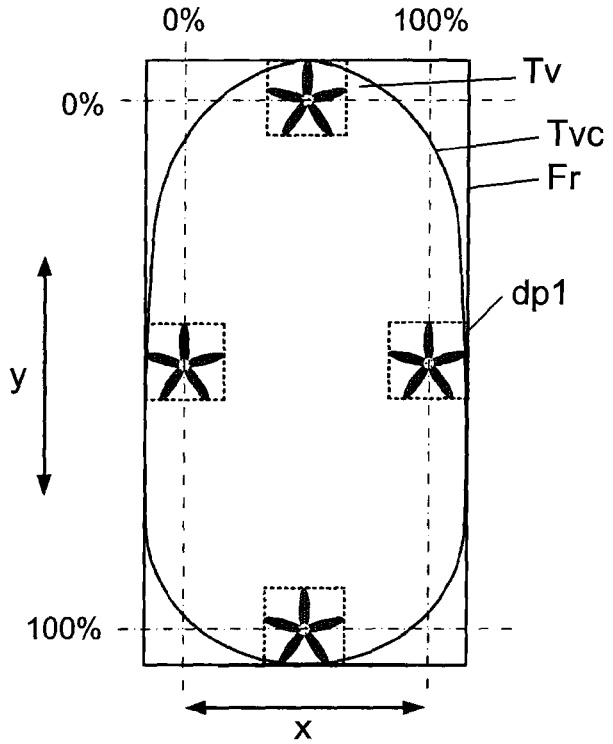
FIG. 11 is an explanatory diagram which describes a 0% position and a 100% position in a horizontal direction and a vertical direction of a design element dp1 of the design image e.

FIG. 11 is an explanatory diagram which describes a 0% position and a 100% position in a horizontal direction and a vertical direction of a design element dp1 of the design image e.

Figure 12:
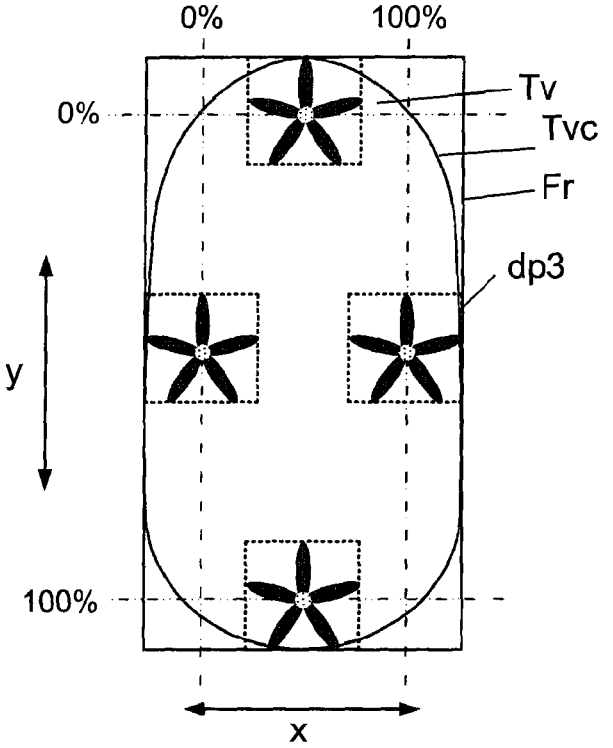
FIG. 12 is an explanatory diagram which describes a 0% position and a 100% position in a horizontal direction and a vertical direction of a design element dp3 of the design image e.

FIG. 12 is an explanatory diagram which describes a 0% position and a 100% position in a horizontal direction and a vertical direction of a design element dp3 of the design image e.

The design image e is composed of four design elements dp1 to dp4. As shown in FIG. 10, the size data, the position data and the picture data are corresponded to each other for each design element dp and the above is stored in the design data storing section 511.

The standard nail model Tv shown in FIG. 9 is stored in advance in the storage section 51 as the nail region including an average shape. The standard nail model Tv is set to an average shape of a nail among a plurality of people.

The size data of each design element dp shown in FIG. 10 shows a value of an area ratio of an area of each design element dp to an area of a standard nail model Tv when the design image is positioned on the standard nail model Tv. In other words, the size data of each design element dp shows a value of an area ratio (%) of each design element dp when the area of the standard nail model Tv is 100%. With this, the size of each design element is specified with the area of the standard nail model Tv as the standard.

For example, when the area of the standard nail model Tv is 100%, the size of the design element dp1 is 20%, the size of the design element dp2 is 28%, the size of the design element dp1 is 28% and the size of the design element dp4 is 20%.

The position data of each design element dp shows a relative position (%) of the center of each design element dp in the x-axis direction and the y-axis direction when the length in the horizontal direction (x-axis direction) of the standard nail model Tv and the length in the vertical direction (y-axis direction) of the standard nail model Tv are the standard. With this, the position of each design element dp in the nail region of the standard nail model Tv is specified.

In the present embodiment, the position of each design element dp in the horizontal direction (x-axis direction) is shown as a relative position with the 0% and 100% position in the horizontal direction shown in FIG. 11 and FIG. 12 as the standard.

Here, as shown in FIG. 9, a standard frame Fr which has a rectangular shape and contacts with the top, bottom, left, and right of the outline Tvc showing the outer perimeter of the standard nail model Tv is set.

The position of 0% in the horizontal direction is set to a position where the center of the design element dp is positioned when the design element dp is positioned on the standard nail model Tv in a position where the left edge of the design element dp overlaps with the left side of the standard frame Fr.

The position of 100% in the horizontal direction is set to a position where the center of the design element dp is positioned when the design element dp is positioned on the standard nail model Tv in a position where the right edge of the design element dp overlaps with the right side of the standard frame Fr.

The position in the vertical direction (y-axis direction) of each design element dp is similarly shown as a relative position with the position of 0% and 100% in the vertical direction shown in FIG. 11 and FIG. 12 as the standard.

The position of 0% in the vertical direction is set to a position where the center of the design element dp is positioned when the design element dp is positioned on the standard nail model Tv in a position where the upper edge of the design element dp overlaps with the upper side of the standard frame Fr.

The position of 100% in the vertical direction is set to a position where the center of the design element dp is positioned when the design element dp is positioned on the standard nail model Tv in a position where the lower edge of the design element dp overlaps with the lower side of the standard frame Fr.

Here, the position of 0% and the position of 100% in the position in the horizontal direction (x-axis direction) and the position in the vertical direction (y-axis direction) change depending on the size of each design element dp.

In other words, as shown in FIG. 11 and FIG. 12, the distance from the center to the edge section of the design element dp is different depending on the size of the design element dp. Regarding a design element dp with a relatively small size, (for example, design elements dp1 and dp4 shown in FIG. 9 and FIG. 10) the distance from the center to the edge section of the design element dp is short. Therefore, the position of 0% and the position of 100% become a position relatively close to each side of the standard frame Fr (see FIG. 11).

Regarding a design element dp with a relatively large size, (for example, design elements dp2 and dp3 shown in FIG. 9 and FIG. 10) the distance from the center to the edge section of the design element dp is longer than that of the design element dp of a small size. Therefore, the position of 0% and the position of 100% is a position relatively far from each side of the standard frame Fr (see FIG. 12).

FIG. 9 shows a relative position of the design element dp1 in a range from 0% to 100% in the horizontal direction (x-axis direction) and the vertical direction (y-axis direction) with an alternate long and short dash line. The relative position of the design element dp in a range from 0% to 100% in the horizontal direction (x-axis direction) and the vertical direction (y-axis direction) is shown with an alternate long and two short dashes line.

As shown in FIG. 9 and FIG. 10, among the design elements dp1 to dp4 composing the design image e of the present embodiment, the design element dp1 is positioned in a position of 50% in the horizontal direction (x-axis direction) and 15% in the vertical direction (y-axis direction) on the standard nail model Tv.

The design element dp3 is positioned in a position of 80% in the horizontal direction (x-axis direction) and 70% in the vertical direction (y-axis direction) on the standard nail model Tv.

The picture data is image data of the picture itself of each design element dp. As picture data, image data composed of a plurality of dots such as a floral pattern or cherry blossom pattern (for example, design image b), crystal pattern of snow (for example, design image a), and the like are stored as, for example, bitmap data (bmp). The data format of the picture data is not limited to bit map data (bmp) and can be stored in other data formats.

Figures 13, 14:
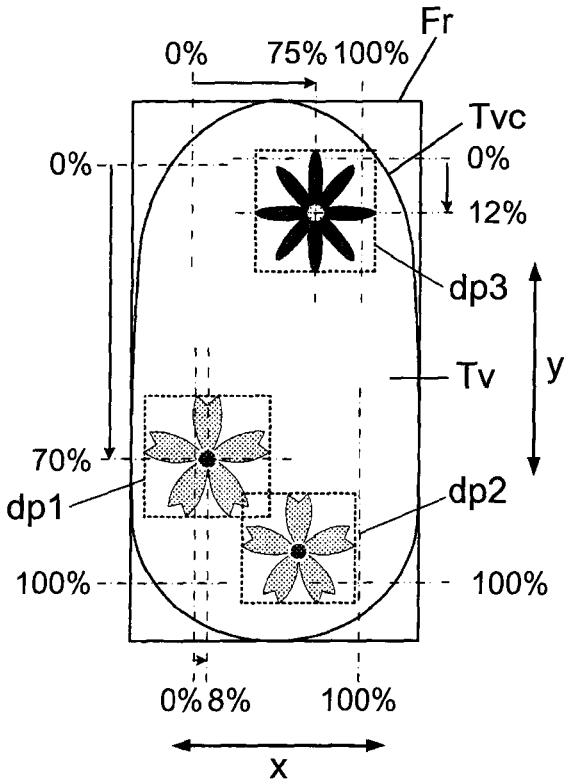
FIG. 13 is an explanatory diagram showing an example of a configuration of a design image b.
FIG. 14 is a chart showing an example of a configuration of data of the design image b.

FIG. 13 is an explanatory diagram showing an example of a configuration of the design image b shown in FIG. 6 where the design image b is positioned on the standard nail model.

FIG. 14 is a chart showing an example of a configuration of data of the design image b shown in FIG. 13.

The design image b is composed from design elements dp1 to dp3. As shown in FIG. 14, the size data, the position data, and the picture data are stored corresponded to each other for each design element in the design data storing section 511.

FIG. 13 shows a relative position of the design element dp1 in a range from 0% to 100% in the horizontal direction (x-axis direction) and the vertical direction (y-axis direction) with an alternate long and short dash line. The relative position of the design element dp3 in a range from 0% to 100% in the horizontal direction (x-axis direction) and the vertical direction (y-axis direction) is shown with an alternate long and two short dash line.

The position of 0% and the position of 100% in the position in the horizontal direction (x-axis direction) and the position in the vertical direction (y-axis direction) of each design element dp are similar to those of the above described design image e (see FIG. 11 and FIG. 12), and therefore the description is omitted.

As shown in FIG. 13 and FIG. 14, among the design elements dp1 to dp3 composing the design image b of the present embodiment, the design element dp1 is picture data of a cherry blossom pattern, a size of 30%, and is positioned in a position of 8% in the horizontal direction (x-axis direction) and 70% in the vertical direction (y-axis direction) on the standard nail model Tv.

The design element dp3 is picture data of a floral pattern b, a size of 34%, and positioned in a position of 75% in the horizontal direction (x-axis direction) and 12% in the vertical direction (y-axis direction) on the standard nail model Tv.

Next, the method of determining the printing size and the printing position of the design element dp in the nail print apparatus 1 of the present embodiment is described with reference to FIG. 19 to FIG. 36.

Figures 19, 20:
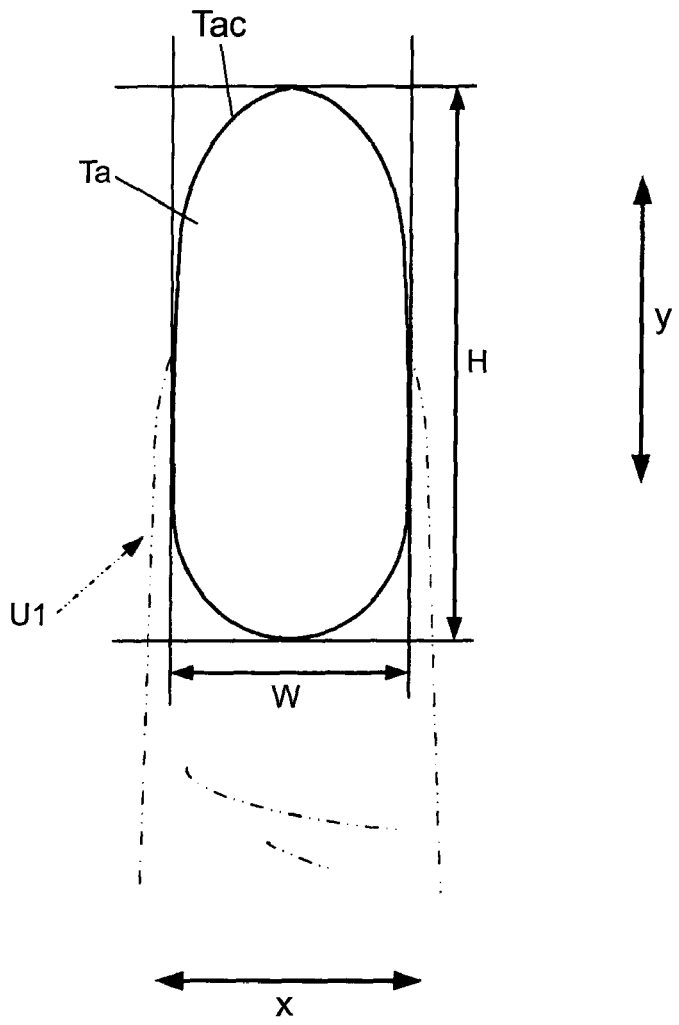
FIG. 19 is a diagram showing an example of a shape of a nail region of a user.
FIG. 20 is a chart showing an example of a configuration of the nail region information of the nail region shown in FIG. 19.

FIG. 19 is a diagram showing an example of a shape of a nail region of the user.

FIG. 20 is a chart showing an example of a configuration of the nail region information of the nail region shown in FIG. 19.

A nail region Ta shown in FIG. 19 is extracted from the finger image of the print finger U1 of the user obtained with the imaging section 30. The storage section 51 of the present embodiment is provided with a nail region data storing section 512 which stores data of an outline Tac showing a shape of the nail region Ta and an outer perimeter of the nail region Ta shown in FIG. 19 and nail region information of the nail region Ta including area S of the nail region Ta and length W in the horizontal direction and length H in the vertical direction shown in FIG. 20.

In FIG. 19, a portion other than the nail region Ta of the print finger U1 is shown with an alternate and two short dashes line for the purpose of illustration.

The storage section 51 of the present embodiment is provided with a print design image storing section 513 which stores a print design image generated by a later described print design image generating section.

For example, as shown in FIG. 20, the area (S) of the nail region Ta of the present embodiment is shown with a number of dots composing the nail region Ta. Here, one dot corresponds to a dot composing image data of each design element. The present embodiment shows an example where the area S of the nail region Ta is composed of 21593 dots.

As shown in FIG. 19 and FIG. 20, the length of the nail region Ta in the horizontal direction (width: W) shows the length of the nail region Ta in the horizontal direction (x-axis direction) with the number of dots. The present embodiment shows an example where the number of dots of the nail region Ta in the horizontal direction is 115 dots.

As shown in FIG. 19 and FIG. 20, the length of the nail region Ta in the vertical direction (height: H) shows the length of the nail region Ta in the vertical direction (y-axis direction) with the number of dots. The present embodiment shows an example where the number of dots of the nail region Ta in the vertical direction is 211 dots.

According to the present embodiment, the control device 50 includes functional sections such as a main body control section 52, a nail region information detecting section 53, a print design image generating section 54, an element position judging section 55, a design image adjusting section 58, and the like. The design image adjusting section 58 includes a design image moving section 56 and a design image reducing section 57.

The main body control section 52 is a functional section which generally controls the entire nail print apparatus 1.

According to the present embodiment, the main body control section 52 controls the imaging section 30 to photograph the print finger U1 of the user and obtains the finger image of the print finger U1 of the user.

The main body control section 52 includes a printing control section 59 which outputs later described print data to the printing section 40 and which controls the printing section 40 to perform printing on the nail region Ta according to the print data.

The nail region information detecting section 53 extracts the nail region Ta from the finger image obtained by the imaging section 30 and detects the outline Tac of the nail region Ta, the area (S) of the nail region Ta, the length (W) in the horizontal direction (x-axis direction) and the length (H) in the vertical direction (y-axis direction).

The data of the nail region Ta extracted by the nail region information detecting section 53 and the data of the outline Tac of the nail region Ta, the value of the area (S) of the nail region Ta, the value of the length (W) in the horizontal direction, and the value of the length (H) in the vertical direction detected by the nail region information detecting section 53 are sent to the nail region data storing section 512 of the storage section 51 and stored.

The print design image generating section 54 reads out the image data of the design image selected with the design selecting section such as the operating section 12, etc. from the design data storing section 511 and generates image data of the print design image including a coordinate value showing a layout of the design element dp based on the read out image data of the design image and the size of the nail region Ta detected by the nail region information detecting section 53. Here, the "size of the nail region Ta" is the area and the length in the horizontal direction and the vertical direction of the nail region Ta of the print finger U1 of the user.

The print design image generating section 54 includes an element layout calculating section 541. The print design image generating section 54 generates a print design image based on the printing size and the printing position of each design element dp calculated by the element layout calculating section 541 and the picture data of each design element dp included in the design image read out from the design data storing section 511.

The element layout calculating section 541 reads out a design image selected by the design selecting section such as the operating button 121, etc. of the operating section 12 from the design data storing section 511 of the storage section 51. Then, the element layout calculating section 541 calculates the printing size and the printing position of each design element dp according to the size data and the position data of each design element dp included in the read out design image and the area S and the length W in the horizontal direction and the length H in the vertical direction of the nail region Ta detected by the nail region information detecting section 53.

The element layout calculating section 541 replaces the area and the length in the horizontal direction and the length in the vertical direction of the standard nail model Tv with the area S and the length W in the horizontal direction and the length H in the vertical direction of the nail region Ta of the print finger U1 of the user detected by the nail region information detecting section 53 and calculates the printing size and the printing position of each design element dp.

In other words, for example, the size of the design element dp1 of the design image e on the standard nail model Tv is 20%. Therefore, the element layout calculating section 541 calculates the size (number of dots) which is to be 20% with respect to the area (S) of the nail region Ta of the print finger U1 and this is to be the printing size of the design element dp.

In the design image e, the design element dp1 is set to be positioned in a position of 50% in the horizontal direction (x-axis direction) and a position of 15% in the vertical direction (y-axis direction) on the standard nail model Tv. Therefore, the element layout calculating section 541 calculates the position which is 50% in the horizontal direction (x-axis direction) and 15% in the vertical direction (y-axis direction) in the nail region Ta of the print finger U1 as the printing position of the design element dp1.

Here, the position of 0% and the position of 100% changes according to the size of the design element dp. Therefore, the element layout calculating section 541 first sets a rectangular nail region frame Fa which has rectangular shape and surrounds the nail region Ta of the print nail U1. Each side of the rectangular nail region frame Fa is set so as to be in contact with the top, bottom, left, and right of the outline Tac of the nail region Ta. The nail region frame Fa is set so as to be in contact with the top, bottom, left, and right of the outline Tac of the nail region Ta.

Then, the element layout calculating section 541 positions on the nail region Ta the design element dp of the printing size calculated as described above in a position so that the left edge overlaps with the left side of the nail region frame Fa of the nail region Ta. Here, the position where the center of the design element dp is positioned is the position of 0% in the horizontal direction. The position where the center of the design element dp is positioned when the design element dp is positioned on the nail region Ta in the position where the right edge of the design element dp overlaps with the right side of the nail region frame Fa of the nail region Ta is the position of 100% in the horizontal direction.

The position of 0% and the position of 100% are determined similarly in the vertical direction (y-axis direction).

Then, the element layout calculating section 541 sets the printing position in the horizontal direction (x-axis direction) of the design element dp1 in a position where the center of the design element dp is provided in the position of 50% set in the design image e within the range of 0% to 100% on the nail region Ta. The element layout calculating section 541 sets the printing position in the vertical direction (y-axis direction) of the design element dp in a position where the center of the design element dp is provided in the position of 15% set in the design image e within the range of 0% to 100% on the nail region Ta.

Figure 21:
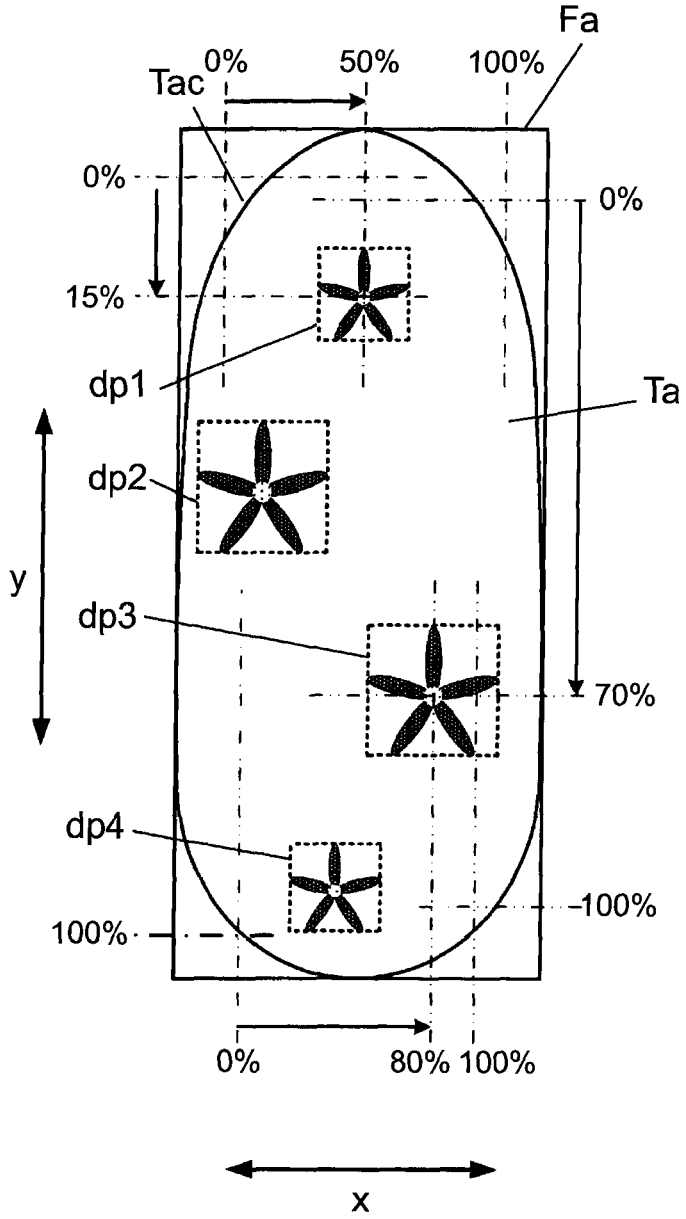
FIG. 21 is a diagram in which the design image e is positioned on the nail region which is a long and narrow shape compared to the standard nail model.
Figure 22:
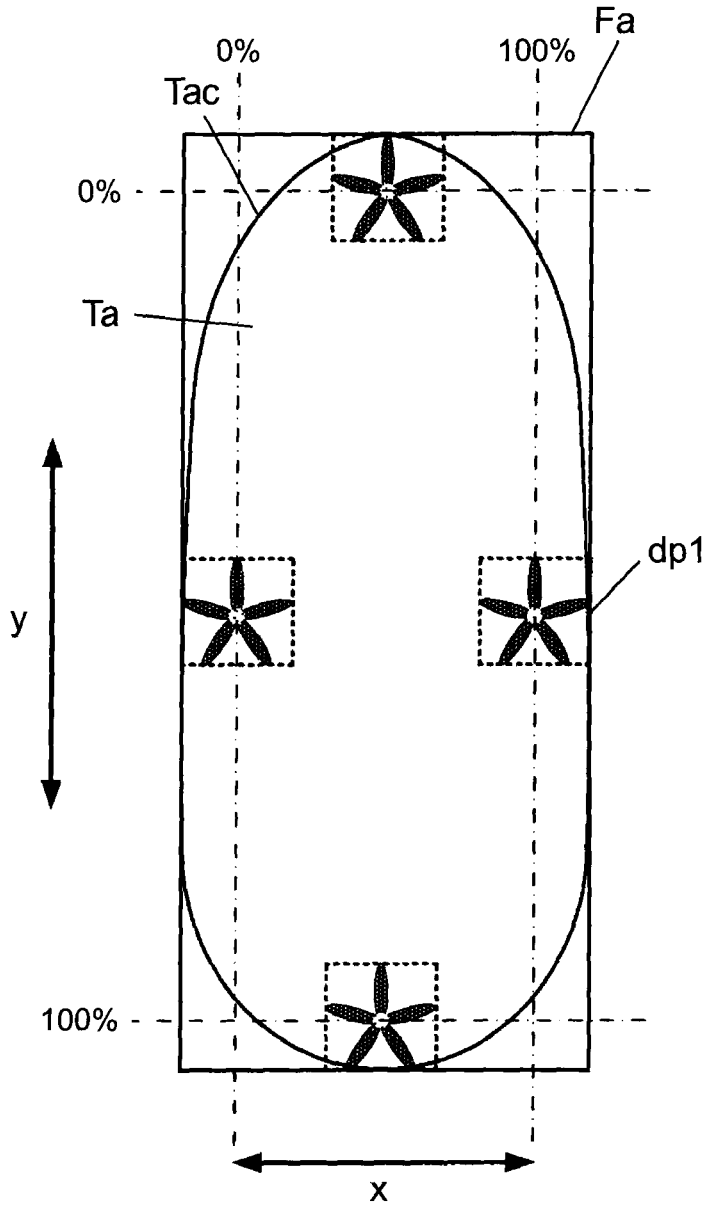
FIG. 22 is an explanatory diagram which describes how to determine a 0% position and a 100% position in a horizontal direction and a vertical direction of a design element of dp1 of the design image e shown in FIG. 21.
Figure 23:
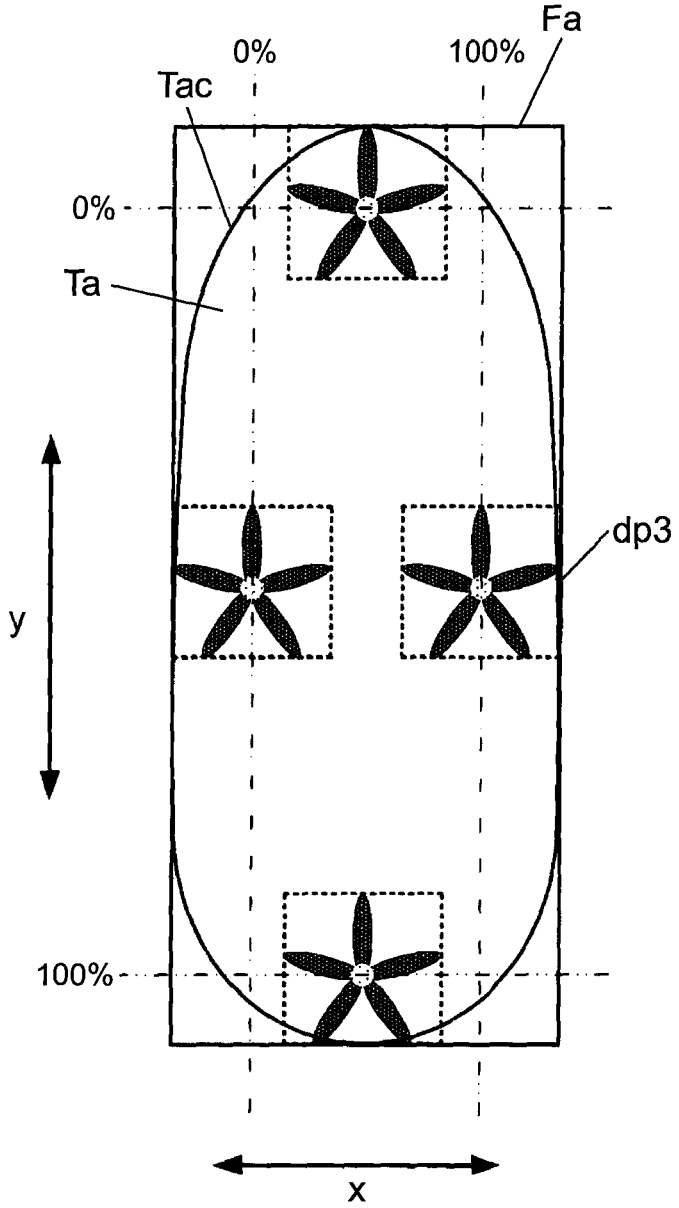
FIG. 23 is an explanatory diagram which describes how to determine a 0% position and a 100% position in a horizontal direction and a vertical direction of a design element of dp3 of the design image e shown in FIG. 21.

FIG. 21 to FIG. 23 are explanatory diagrams which describe how to determine the printing size and the printing position of each design element dp when the nail region Ta of the print finger U1 of the user is a long and narrow shape compared to the standard nail model Tv.

FIG. 21 is a diagram in which the design image e is positioned on the nail region which is a long and narrow shape compared to the standard nail model.

FIG. 22 is an explanatory diagram which describes how to determine a 0% position and a 100% position in the horizontal direction and the vertical direction of a design element of dp1 of the design image e shown in FIG. 21.

FIG. 23 is an explanatory diagram which describes how to determine a 0% position and a 100% position in the horizontal direction and the vertical direction of a design element of dp3 of the design image e shown in FIG. 21.

In this case, the element layout calculating section 541 first calculates the printing size of each design element dp according to the area of the nail region Ta.

Next, the element layout calculating section 541 positions the design element dp of the calculated printing size on the nail region Ta to calculate the position of 0% and the position of 100% vertically and horizontally for each design element dp (See FIG. 22 regarding design element dp1 of the design image e. See FIG. 23 regarding design element dp3).

Then, as shown in FIG. 21, the element layout calculating section 541 sets the printing position of the design element dp1 in the horizontal direction (x-axis direction) in a position where the center of the design element dp1 is provided in a position of 50% set in the design image e within the range of 0% to 100% on the nail region Ta. The element layout calculating section 541 sets the printing position of the design element dp1 in the vertical direction (y-axis direction) in a position where the center of the design element dp1 is provided in a position of 15% set in the design image e within the range of 0% to 100% on the nail region Ta.

As shown in FIG. 21, the element layout calculating section 541 sets the printing position of the design element dp3 in the horizontal direction (x-axis direction) in a position where the center of the design element dp3 is provided in a position of 50% set in the design image e within the range of 0% to 100% on the nail region Ta. The element layout calculating section 541 sets the printing position of the design element dp3 in the vertical direction (y-axis direction) in a position where the center of the design element dp3 is provided in a position of 15% set in the design image e within the range of 0% to 100% on the nail region Ta.

The element layout calculating section 541 similarly sets the printing position of the other design elements dp2 and dp4.

With this, even if the nail region Ta of the user is a longer and narrower shape than the standard nail model Tv, each design element dp can be positioned to be substantially the same layout as when positioned on the standard nail model Tv.

Figure 24:
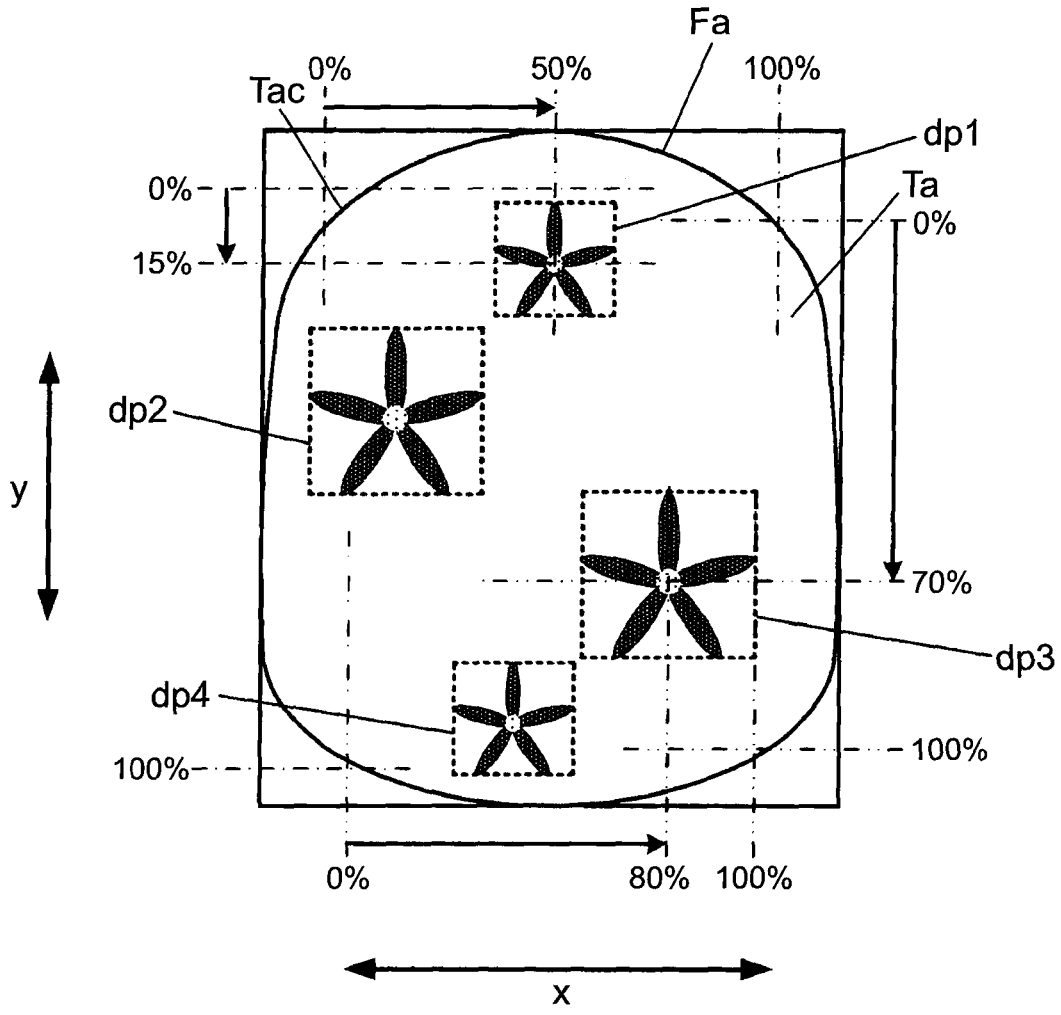
FIG. 24 is a diagram in which the design image e is positioned on the nail region which is a wide shape compared to the standard nail model.
Figure 25:
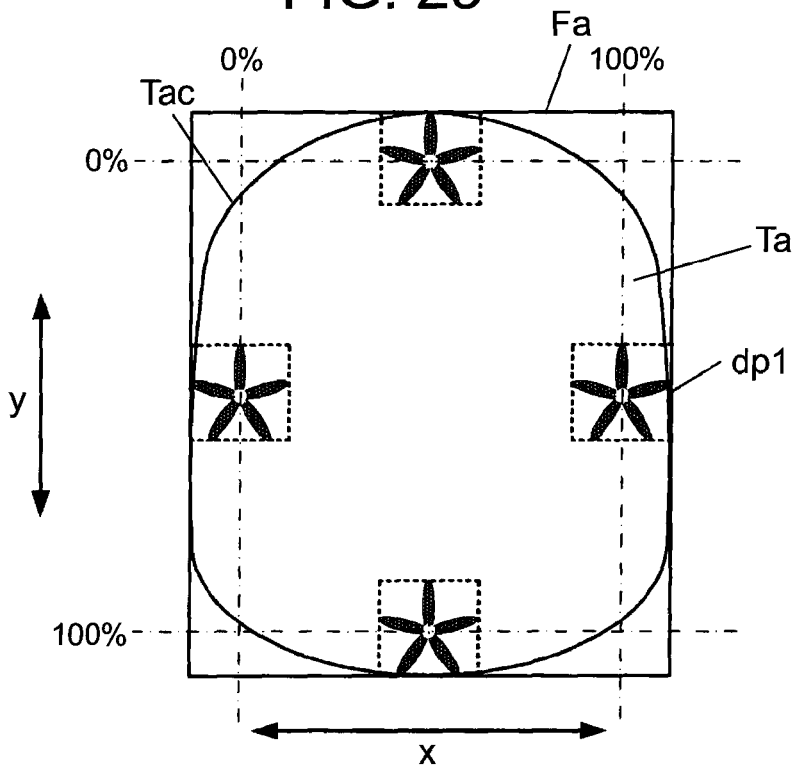
FIG. 25 is an explanatory diagram which describes how to determine a 0% position and a 100% position in a horizontal direction and a vertical direction of a design element of dp1 of the design image e shown in FIG. 24.
Figure 26:
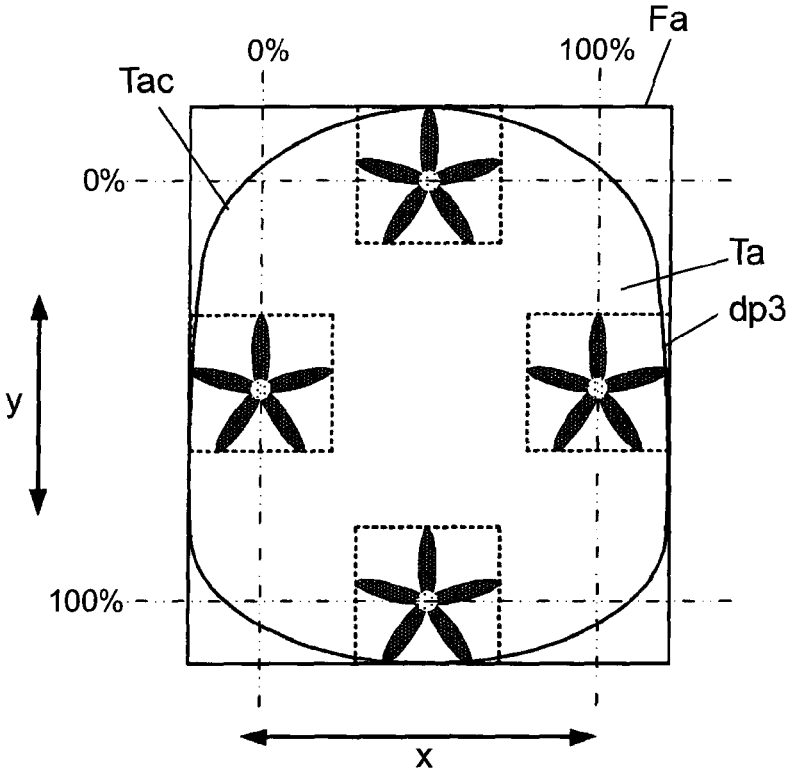
FIG. 26 is an explanatory diagram which describes how to determine a 0% position and a 100% position in a horizontal direction and a vertical direction of a design element of dp3 of the design image e shown in FIG. 24.

FIG. 24 to FIG. 26 are explanatory diagrams showing how to determine the printing size and the printing position of each design element when the shape of the nail region Ta of the print finger U1 of the user is short in length in the vertical direction and wide compared to the standard nail model Tv.

FIG. 24 is a diagram in which the design image e is positioned on the nail region which is wide compared to the standard nail model.

FIG. 25 is an explanatory diagram which describes how to determine a 0% position and a 100% position in the horizontal direction and the vertical direction of a design element of dp1 of the design image e shown in FIG. 24.

FIG. 26 is an explanatory diagram which describes how to determine a 0% position and a 100% position in a horizontal direction and a vertical direction of a design element of dp3 of the design image e shown in FIG. 24.

In this case, the element layout calculating section 541 first calculates the printing size of each design element dp according to the area of the nail region Ta.

Next, the element layout calculating section 541 positions the design element dp of the calculated printing size on the nail region Ta to calculate the position of 0% and the position of 100% vertically and horizontally for each design element dp (See FIG. 25 regarding design element dp1 of the design image e. See FIG. 26 regarding design element dp3).

Then, as shown in FIG. 24, the element layout calculating section 541 sets the printing position of the design element dp1 in the horizontal direction (x-axis direction) in a position where the center of the design element dp1 is provided in a position of 50% set in the design image e within the range of 0% to 100% on the nail region Ta. The element layout calculating section 541 sets the printing position of the design element dp1 in the vertical direction (y-axis direction) in a position where the center of the design element dp1 is provided in a position of 15% set in the design image e within the range of 0% to 100% on the nail region Ta.

As shown in FIG. 24, the element layout calculating section 541 sets the printing position of the design element dp3 in the horizontal direction (x-axis direction) in a position where the center of the design element dp3 is provided in a position of 50% set in the design image e within the range of 0% to 100% on the nail region Ta. The element layout calculating section 541 sets the printing position of the design element dp3 in the vertical direction (y-axis direction) in a position where the center of the design element dp3 is provided in a position of 15% set in the design image e within the range of 0% to 100% on the nail region Ta.

The element layout calculating section 541 similarly sets the printing position of the other design elements dp2 and dp4.

With this, even if the nail region Ta of the user is a shape longer in the vertical direction and wider than the standard nail model Tv, each design element dp can be positioned to be substantially the same layout as when positioned on the standard nail model Tv.

The following describes a first method of determining the printing size and the printing position of the design element dp in order to position all of the design elements dp in the design image in a position that does not fall out from the nail region of the user.

Figure 27:
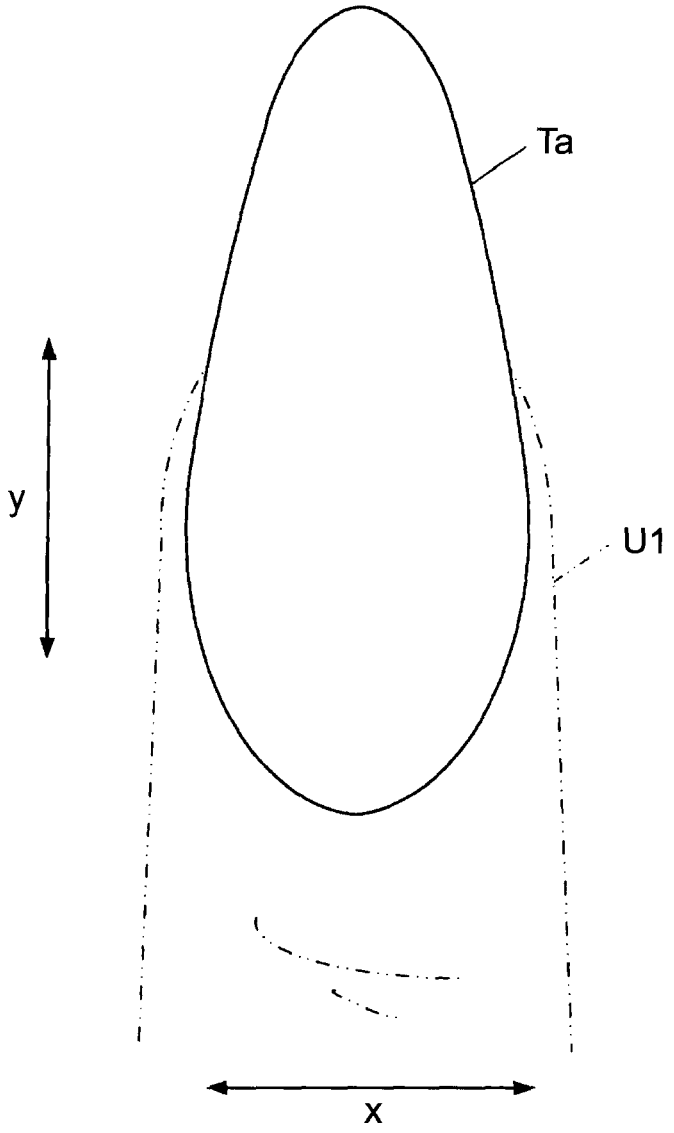
FIG. 27 is a diagram showing another example of a shape of a nail region of the user.

FIG. 27 is a diagram showing another example of a shape of a nail region of the user.

Figure 28:
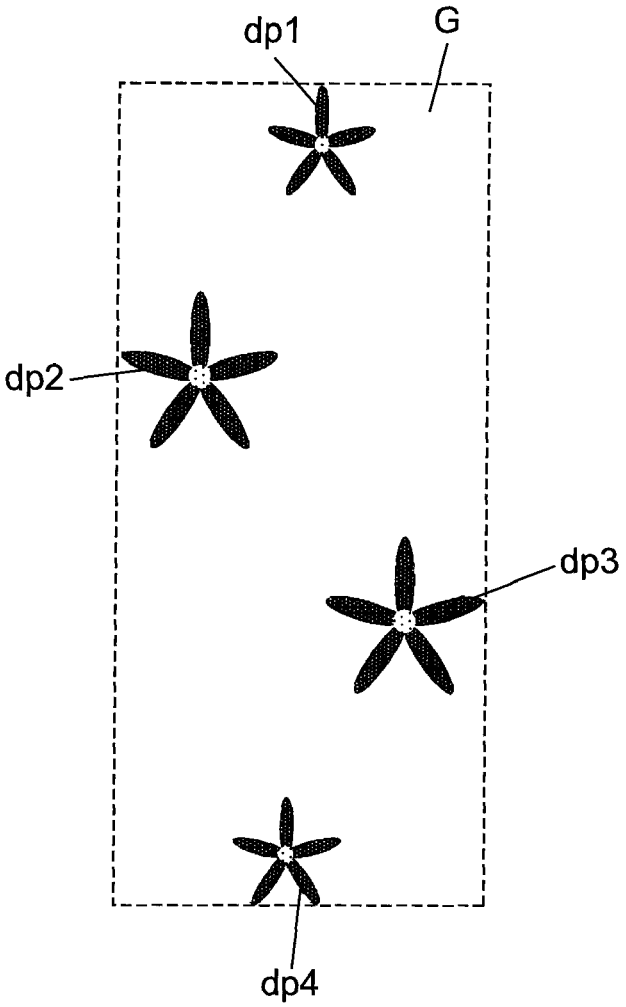
FIG. 28 is a diagram showing an example of a print design image.

FIG. 28 is a diagram showing an example of a print design image.

Figure 29:
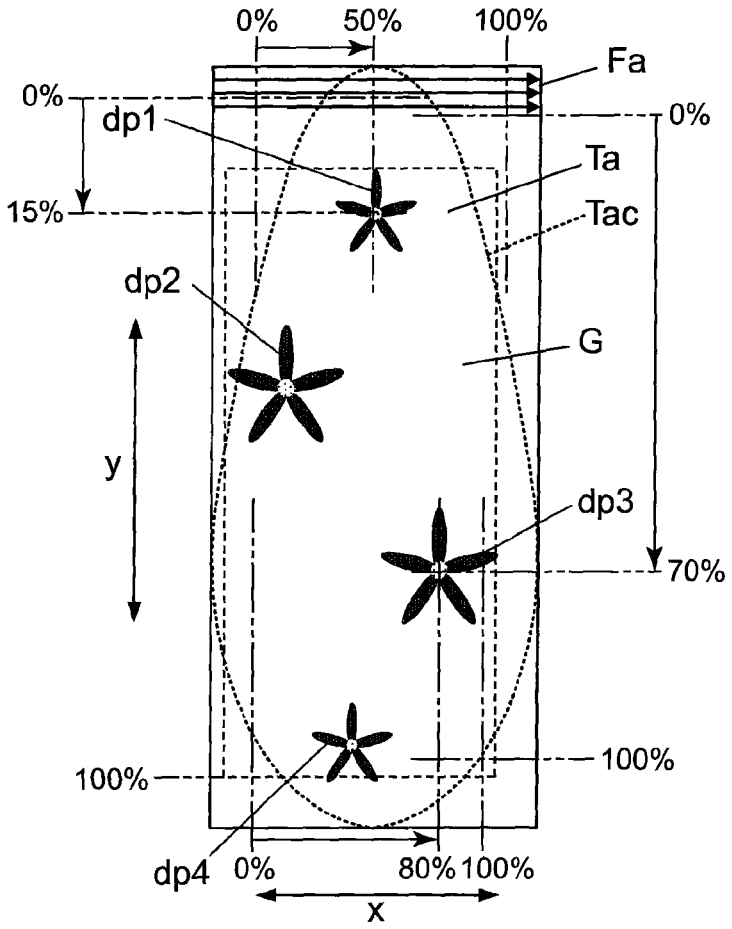
FIG. 29 is a diagram showing a state of overlapping the print design image shown in FIG. 28 on the nail region shown in FIG. 27.

FIG. 29 is a diagram showing a state of overlapping the print design image shown in FIG. 28 on the nail region shown in FIG. 27.

Figure 30:
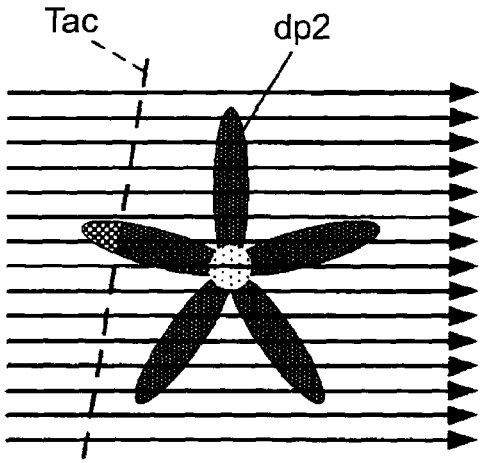
FIG. 30 is an enlarged diagram of an alternate long and short dash line portion shown in FIG. 29.

FIG. 30 is an enlarged diagram of an alternate long and short dash line portion shown in FIG. 29.

The print design image generating section 54 generates a print design image G positioning each design element dp in the printing size and the printing position which matches the area and the length in the horizontal direction and the vertical direction of the nail region Ta of the user as shown in FIG. 28 and FIG. 29 based on the printing size and the printing position of each design element dp calculated by the element layout calculating section 541 and the picture data of each design element dp. As shown in FIG. 29, the print design image G is positioned in the nail region frame Fa which surrounds the nail region Ta.

The image data of the print design image G is data in a bitmap format including information such as a coordinate value, etc. of each design element dp and is image data which can also be used for print data to perform printing.

For example, when the nail region Ta of the user of the print target is a shape as shown in FIG. 27, the image data of the print design image G is bitmap data showing the design image as shown in, for example, FIG. 28. The data format of the image data of the print design image G is not limited to a bitmap data format.

The print design image G generated in the print design image generating section 54 is stored in the print design image storing section 513 of the storage section 51.

The element position judging section 55 compares the coordinate value of the design element dp included in the image data of the print design image G generated by the print design image generating section 54 with the coordinate value of the outline Tac (shown in a broken line in FIG. 29) of the nail region Ta detected by the nail region information detecting section 53. Then, the element position judging section 55 judges whether or not all of the design elements dp are contained within the nail region Ta with the comparison of the coordinate values.

Specifically, as shown in FIG. 29, the element position judging section 55 overlaps the outline Tac along the outer perimeter of the nail region Ta and the print design image G. Then, the element position judging section 55 sequentially scans the nail region frame Fa from the predetermined position of the nail region frame Fa.

Then, the element position judging section 55 performs the above scanning and judges whether or not the coordinate values of all of the design elements dp included in the image data of the print design image G are inside the coordinate values of the outline Tac of the nail region Ta (in other words, within the range of the nail region Ta).

As shown in FIG. 29, the present embodiment describes an example of sequentially scanning from the top line of the image one line at a time from the left to the right, however, the order of scanning is not limited.

After a later described process in which the design image moving section 56 moves the print design image G, the element position judging section 55 compares the coordinate value of the design element dp included in the image data of the print design image G after moving with the coordinate value of the outline Tac of the nail region Ta detected by the nail region information detecting section 53 and judges whether or not all of the design elements dp are contained within the nail region Ta as a result of moving by the design image moving section 56.

After a later described process in which the design image reducing section 57 reduces the print design image G, the element position judging section 55 compares the coordinate value of the design element dp included in the image data of the print design image G after reducing with the coordinate value of the outline Tac of the nail region Ta detected by the nail region information detecting section 53 and judges whether or not all of the design elements dp are contained within the nail region Ta as a result of reducing by the design image reducing section 57.

The print design image G shown in FIG. 29 shows the coordinate value of a portion of the design element dp2 falls outside of the coordinate value of the outline Tac of the nail region Ta. FIG. 30 shows the portion of the design element dp2 which falls out of the outline Ta of the nail region Ta shaded.

When the element position judging section 55 judges that all of the design element dp are contained within the nail region Ta (for example, as shown in FIG. 23 and FIG. 26), the image data of the print design image G is used as is as the print data to print on the nail region Ta.

When the element position judging section 55 judges that at least a portion of the design element dp is not contained within the nail region Ta, the design image moving section 56 moves the print design image G so that all of the design elements dp are contained within the nail region Ta. The movement of the print design image G is performed, for example, one dot at a time.

The design image moving section 56 includes an outer perimeter frame setting section 561, an outer perimeter frame position judging section 562 and an outer perimeter frame adjusting section 563.

When the element position judging section 55 judges that at least a portion of the design element dp is not contained within the nail region Ta, the outer perimeter frame setting section 561 sets an outer perimeter frame F1 of the print design image G and obtains the coordinate value of the outer perimeter frame F1.

The outer perimeter frame position judging section 562 compares the coordinate value of the outer perimeter frame F1 obtained by the outer perimeter frame setting section 561 with the coordinate value of the outline of the nail region Ta detected by the nail region information detecting section 53 and judges whether or not the outer perimeter frame F1 is contained within the nail region Ta.

When the outer frame position judging section 562 judges that the outer perimeter frame F1 is not contained within the nail region Ta, the outer perimeter frame adjusting section 563 adjusts the position and/or the size of the outer perimeter frame F1 so that the outer perimeter frame F1 is contained within the nail region Ta.

The process of the design image moving section 56 moving the print design image G is specifically described with reference to FIG. 31A, FIG. 31B, FIG. 32 and FIG. 33.

Figure 31A:
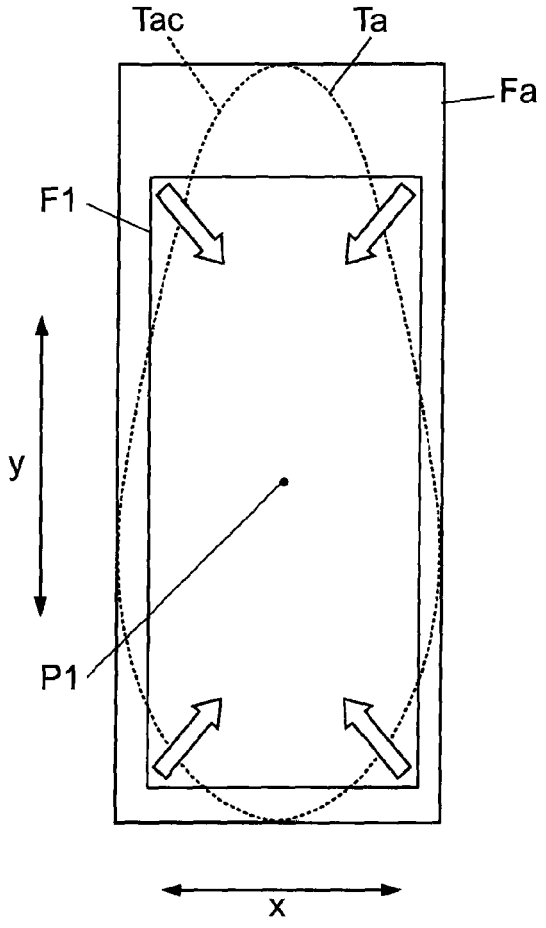
FIG. 31A is a diagram showing a state of overlapping an outer perimeter frame of the print design image shown in FIG. 28 on the nail region shown in FIG. 27.

FIG. 31A is a diagram showing a state of overlapping an outer perimeter frame of the print design image shown in FIG. 28 on the nail region shown in FIG. 27.

Figure 31B:
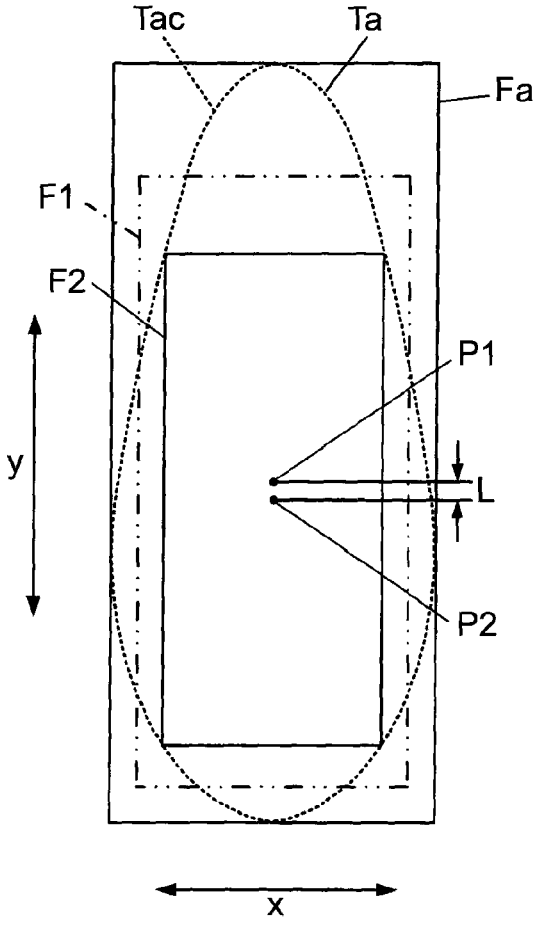
FIG. 31B is a diagram showing a state of overlapping on the nail region shown in FIG. 27 an outer perimeter frame after adjustment in which the outer perimeter frame shown in FIG. 31A is reduced.

FIG. 31B is a diagram showing a state of overlapping an outer perimeter frame after adjustment in which the outer perimeter frame shown in FIG. 31A is reduced on the nail region shown in FIG. 27.

Figure 32:
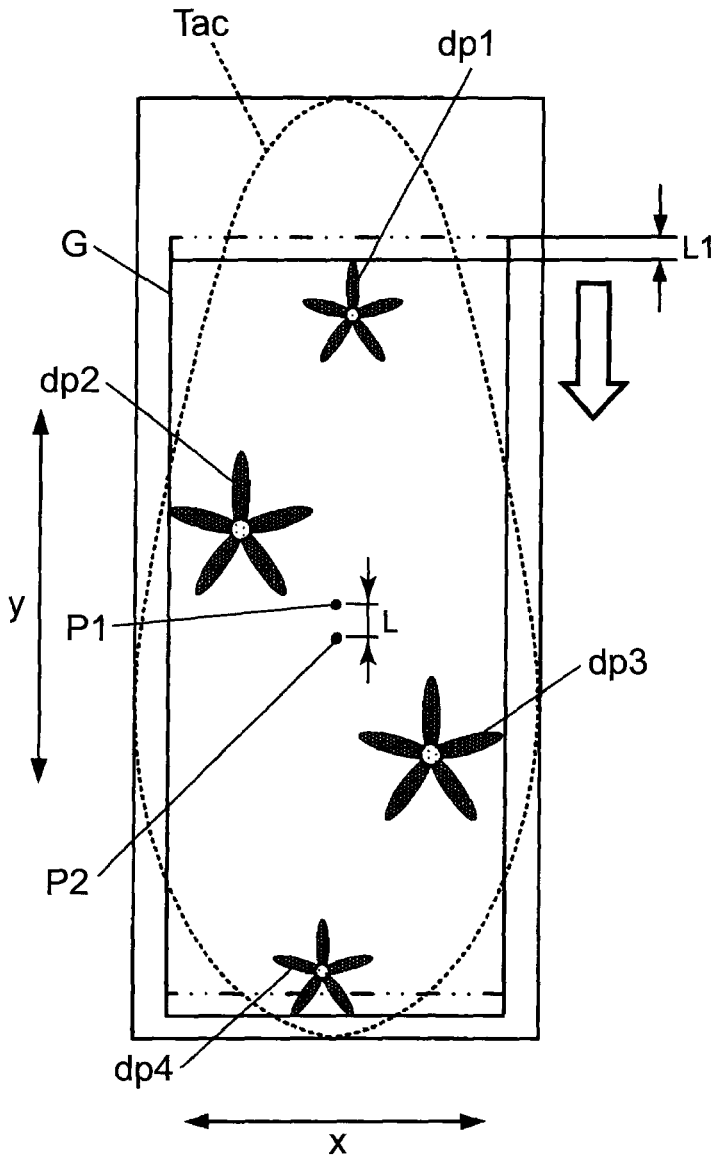
FIG. 32 is a diagram showing a state of moving the outer perimeter frame of the print design image a distance L to overlap the outer perimeter frame on the nail region shown in FIG. 27.

FIG. 32 is a diagram showing a state of moving the outer perimeter frame of the print design image a distance L to overlap the outer perimeter frame on the nail region shown in FIG. 27.

Figure 33:
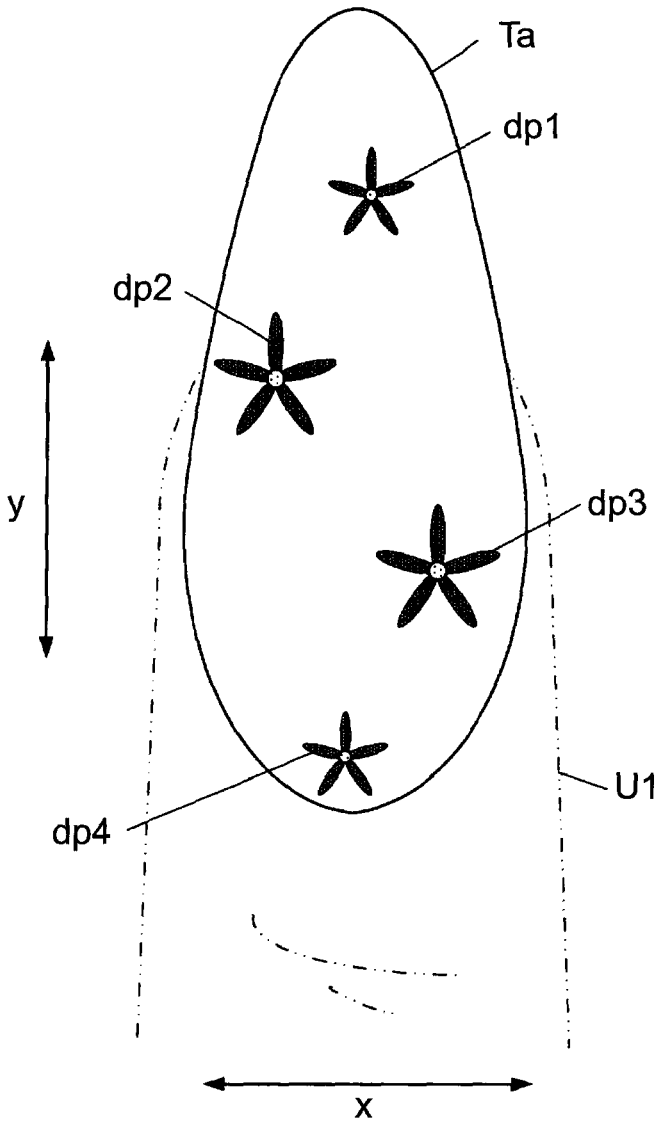
FIG. 33 is a diagram showing an image of a nail section when the print design image is printed in the position shown in FIG. 32.

FIG. 33 is a diagram showing an image of a nail section when the print design image is printed in the position shown in FIG. 32.

When the element position judging section 55 judges that at least a portion of the design element dp (in the present embodiment, design element dp2) is not contained within the nail region Ta, the outer perimeter frame setting section 561 sets the outer perimeter frame F1 of the print design image G as shown in FIG. 31A.

Here, the outer perimeter frame F1 is a frame which draws an outer perimeter of the print design image G. For example, the outer perimeter frame setting section 561 sets the coordinate values in the position at the farthest edge section of the top, bottom, left, and right of the print design image G among the coordinate values of the design element included in the print design image G as the coordinate value of each side composing the outer perimeter frame F1 to set the outer perimeter frame F1 in a box shape composed by four sides.

In the present embodiment, the coordinate of the far upper edge section of the petal of the design element dp1 is the coordinate in the position of the far edge section of the upper side of the print design image G and the coordinate of the far lower edge section of the petal of the design element dp4 is the coordinate in the position of the far edge section of the lower side of the print design image G. Therefore, the outer perimeter frame setting section 561 sets the coordinate values in the y-axis direction of the coordinates as the coordinate values in the y-axis direction of the top and bottom sides of the outer perimeter frame F1. The coordinate of the far left edge section of the petal of the design element dp2 is the coordinate in the position of the far edge section of the left side of the print design image G, the coordinate of the far right edge section of the petal of the design element dp3 is the coordinate in the position of the far edge section of the right side of the print design image G. Therefore, the outer perimeter frame setting section 561 sets the coordinate values in the x-axis direction of the coordinates as the coordinate values in the x-axis direction of the left and right sides of the outer perimeter frame F1. With this, the outer perimeter frame setting section 561 sets a box shaped outer perimeter frame F1 composed of the above four sides.

As shown in FIG. 31A, the outer perimeter frame position judging section 562 overlaps the outer perimeter frame F1 set by the outer perimeter frame setting section 561 (shown with a solid line in FIG. 31A) with the outline Tac of the nail region Ta detected by the nail region information detecting section 53 (shown with a broken line in FIG. 31A). Then, the above is sequentially scanned from a predetermined position. For example, the scanning is sequentially performed from the top line of the image, one line at a time from left to right.

Then, the outer perimeter frame position judging section 562 judges whether or not the coordinate value of the outer perimeter frame F1 is inside the coordinate value of the outline of the nail region Ta (in other words, within the range of the nail region Ta).

The order of scanning by the outer perimeter frame position judging section 562 is not limited to the illustrated examples.

When the outer perimeter frame position judging section 562 judges that the outer perimeter frame F1 is not contained within the nail region Ta, the outer perimeter frame adjusting section 563 first moves the outer perimeter frame F1 vertically along the y-axis direction while reducing the outer perimeter frame F1 and adjusts the position and the size of the outer perimeter frame F1.

Here, the outer perimeter frame adjusting section 563 reduces the outer perimeter frame F1 (shown with alternate short and two dashes line in FIG. 31B) while maintaining the aspect ratio of the outer perimeter frame F1. With this, the outer perimeter frame adjusting section 563 sets the adjusted outer perimeter frame F2 in which the position and the size are adjusted.

When the adjustment by the outer perimeter frame adjusting section 563 is performed, the outer perimeter frame position judging section 562 scans the adjusted outer perimeter frame F2 overlapped on the nail region Ta and judges whether or not the adjusted outer perimeter frame F2 is contained within the nail region Ta.

The adjustment of the outer perimeter frame F1 by the outer perimeter frame adjusting section 563 and the judgment by the outer perimeter frame position judging section 562 are repeated until the outer perimeter frame position judging section 562 judges that the adjusted outer perimeter frame F2 is contained within the nail region Ta.

FIG. 31B shows a state where the outer perimeter frame position judging section 562 judges that the adjusted outer perimeter frame F2 is contained within the nail region Ta.

In FIG. 31B, the outline Tac of the nail region Ta is shown with a broken line, the outer perimeter frame F1 before adjustment (in other words, the outer perimeter position of the print design image G before adjustment) is shown with alternate long and two dashes line, and the adjusted outer perimeter frame F2 is shown with a solid line.

When the outer perimeter frame position judging section 562 judges that the adjusted outer perimeter frame F2 is contained within the nail region Ta as a result of the adjustment by the outer perimeter frame adjusting section 563, the design image moving section 56 moves the print design image G to a position so that a center point P1 (in other words, a center point of the outer perimeter frame F1 showing an original position of the print design image G) matches a center point P2 of the outer perimeter frame F2 after adjustment by the outer perimeter frame adjusting section 563.

Here, as shown in FIG. 32, the print design image G is moved a distance L between the center point P1 and the center point P2 in the vertical direction (y-axis direction) without reducing.

Whether the print design image G is moved in an upper direction or a lower direction along the y-axis direction is determined depending on whether the design element dp initially judged to be outside the nail region Ta as a result of scanning by the element position judging section 55 is in a position above or below the center point P1.

In the present embodiment, as a result of scanning by the element position judging section 55, since the design element dp2 initially judged to be outside the nail region Ta is in a position above the center point P1, the print design image G is moved in a lower direction along the y-axis direction.

When the design image moving section 56 moves the print design image G, as described above, the element position judging section 55 judges whether or not all of the design elements dp included in the moved print design image G are contained within the nail region Ta.

When all of the design elements dp included in the print design image G are contained within the nail region Ta as a result of moving the print design image G with the design image moving section 56 (for example, as shown in FIG. 23), the image data of the moved print design image G is used as the print data for printing on the nail region Ta.

When the printing position of the print design image G is set to the position shown in FIG. 32 and printing is performed, the image shown in FIG. 33 is printed on the nail region Ta.

When the element position judging section 55 judges that at least a portion of the design element dp after moving the print design image g is not contained within the nail region Ta, the design image reducing section 57 reduces the print design image G. The reduction of the print design image G is performed, for example, one dot at a time.

The design image reducing section 57 reduces the print design image G at a ratio according to the reduction ratio of the outer perimeter frame F2 after adjustment by the outer perimeter frame adjusting section 563 with respect to the outer perimeter frame F1 before adjustment.

When the outer perimeter frame F1 is reduced, the design image reducing section 57 does not change the position of the center point P2 of the outer perimeter frame F1 after moving by the design image moving section 56 and only the size is reduced.

Next, a second method of determining a printing size and a printing position of the design element dp in order to position all of the design elements dp of the design image in a position which is not outside the nail region of the user is described.

Figure 34A:
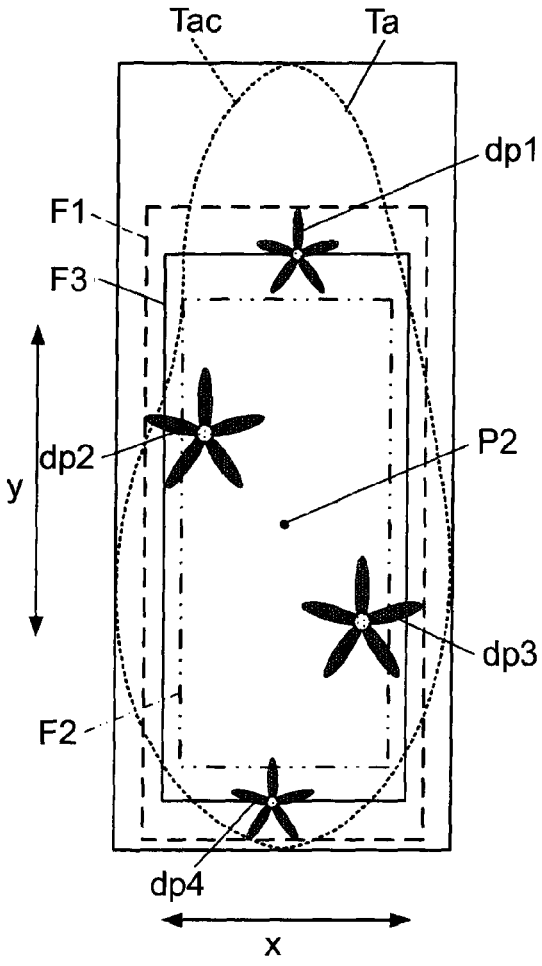
FIG. 34A is a diagram showing a state of overlapping an intermediate outer perimeter frame on the nail region.

FIG. 34A is a diagram showing a state of overlapping an intermediate outer perimeter frame on the nail region.

Figure 34B:
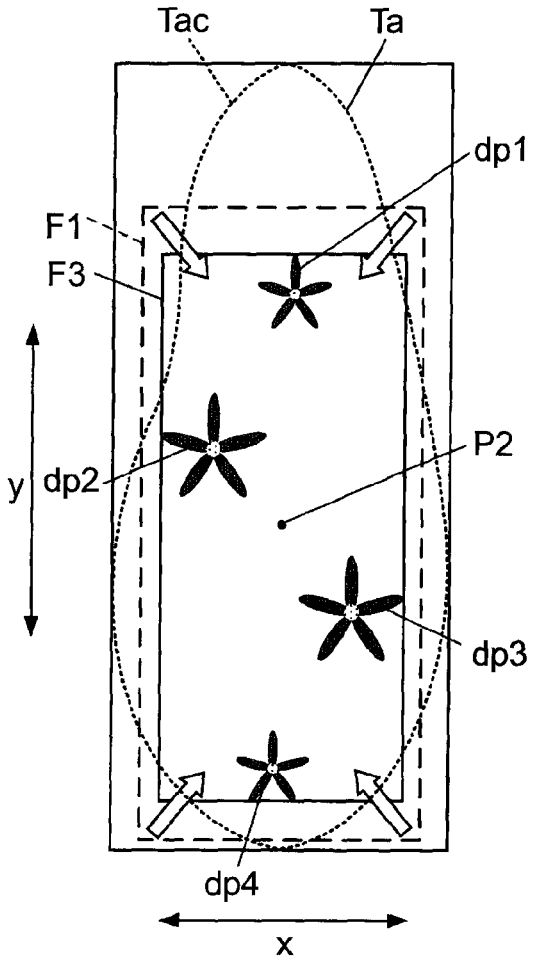
FIG. 34B is a diagram showing a state of overlapping the print design image reduced to a size within the intermediate outer perimeter shown in FIG. 34A on the nail region.

FIG. 34B is a diagram showing a state of overlapping the print design image reduced to a size within the intermediate outer perimeter shown in FIG. 34A on the nail region.

Figure 35A:
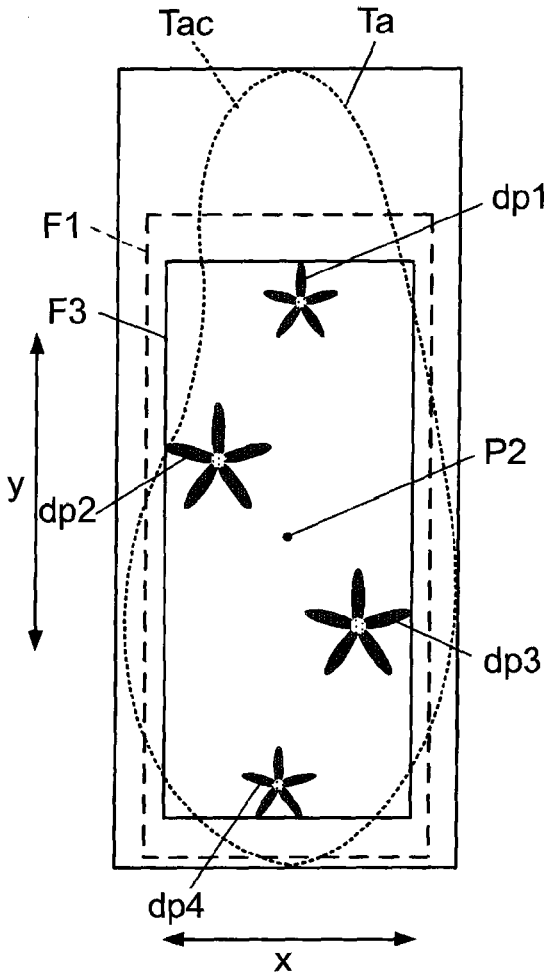
FIG. 35A is a diagram showing a state of overlapping the print design image reduced to a size within the intermediate outer perimeter frame on the nail region.

FIG. 35A is a diagram showing a state of overlapping the print design image reduced to a size within the intermediate outer perimeter frame to the nail region.

Figure 35B:
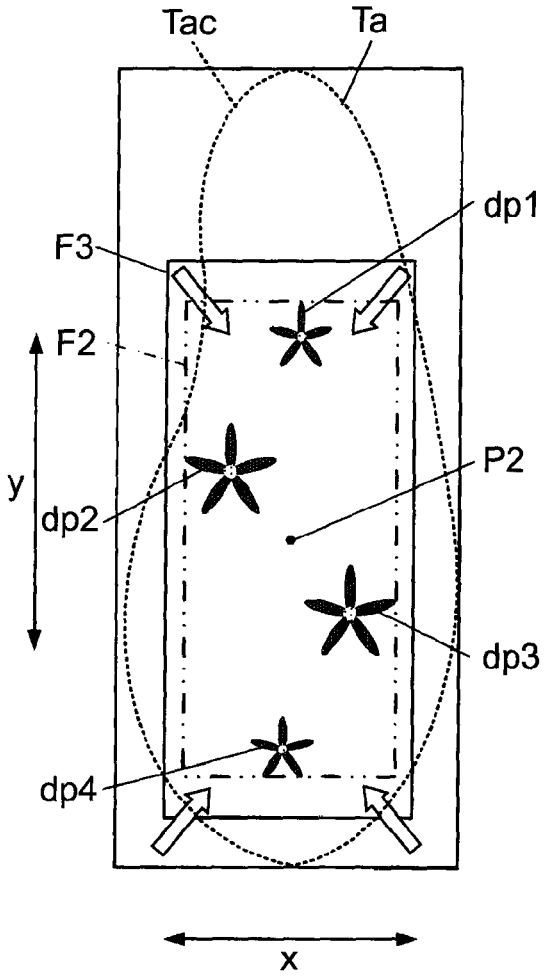
FIG. 35B is a diagram showing a state of overlapping the print design image reduced to the size within the adjusted outer perimeter frame on the nail region.

FIG. 35B is a diagram showing a state of overlapping the print design image reduced to the size within the adjusted outer perimeter frame on the nail region.

Figure 36:
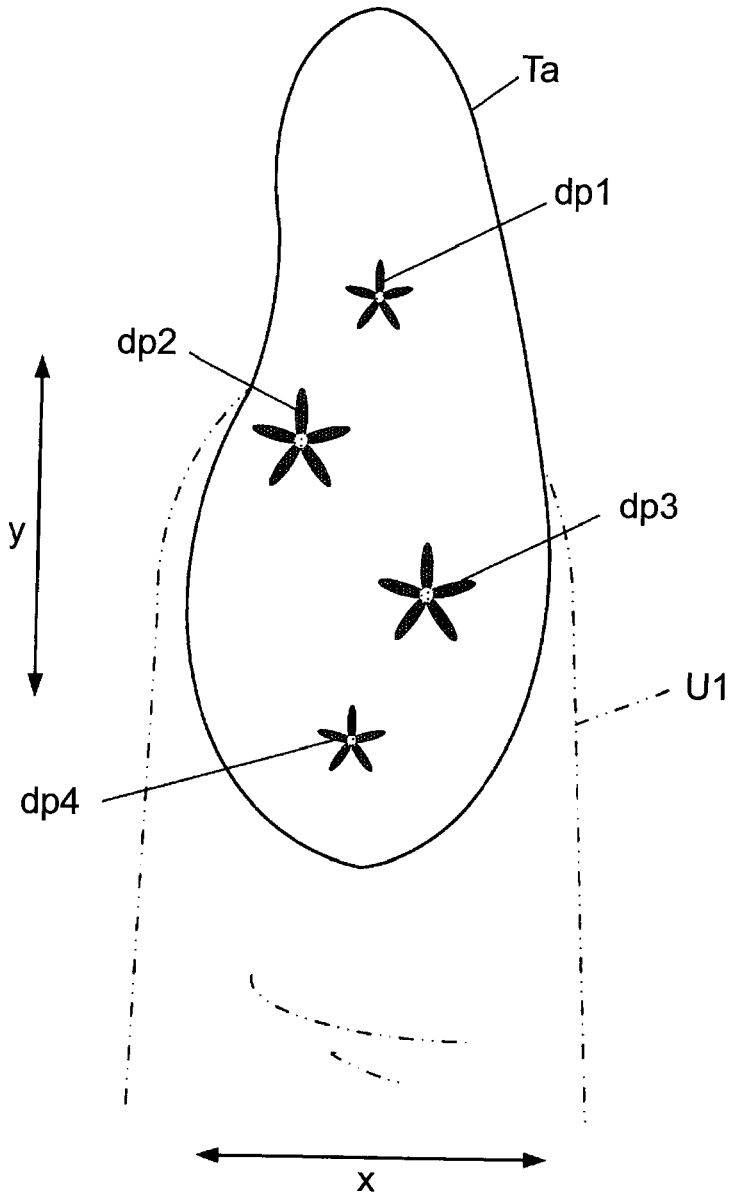
FIG. 36 is a diagram showing an image of a nail section when the print design image is printed in the position shown in FIG. 35B.
Figure 37A:
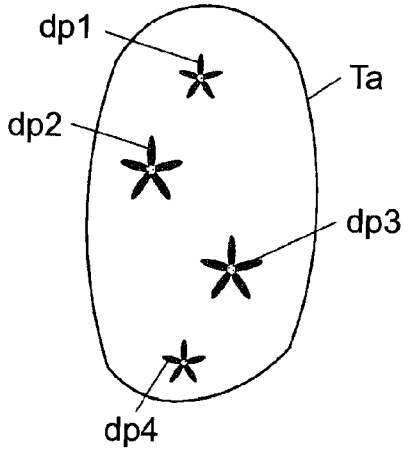
FIG. 37A to FIG. 37F are diagrams showing an image of a nail section when a design image is printed on a nail region of various shapes by using the print control method of the present embodiment.
Figure 37B:
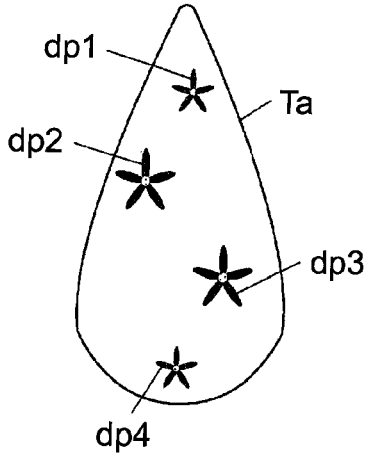
Figure 37C:
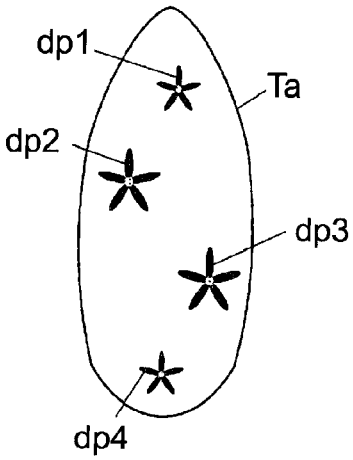
Figure 37D:
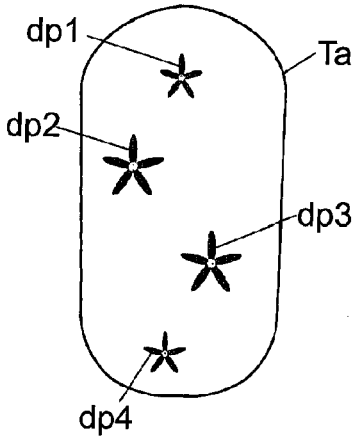
Figure 37E:
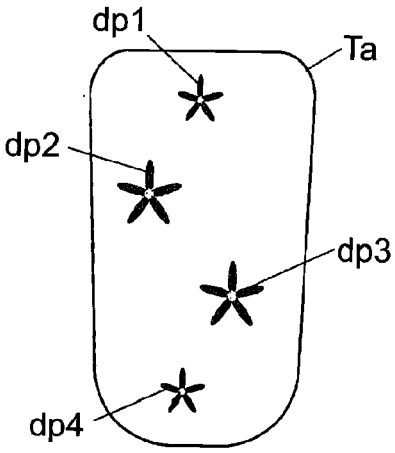
Figure 37F:
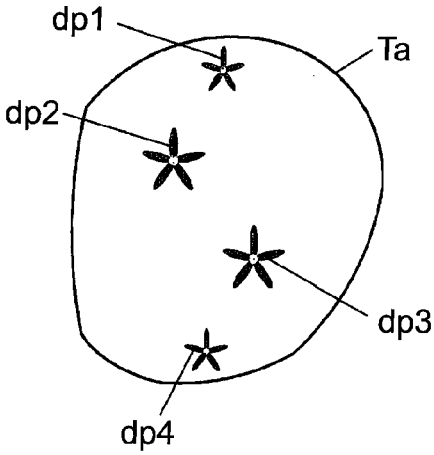

FIG. 36 is a diagram showing an image of a nail section when the print design image is printed in the position shown in FIG. 35B.

FIG. 37A to FIG. 37F are diagrams showing an image of a nail section when a design image is printed on a nail region of various shapes by using the print control method of the present embodiment.

Here, the following describes an example where the nail region Ta is a shape different from the shape shown in FIG. 27 and has a shape where a portion is dented as shown in FIG. 34A, FIG. 34B, FIG. 35A, FIG. 35B and FIG. 36.

The design image reducing section 57 calculates the average value of the corresponding coordinates of the coordinate value of the outer perimeter frame F2 after adjustment by the outer perimeter frame adjusting section 563 (frame shown with an alternate long and two dashes line in FIG. 34A) and the coordinate value of the outer perimeter frame F1 before adjustment (frame shown with a broken line in FIG. 34A and FIG. 34B). The design image reducing section 57 includes an intermediate outer perimeter frame setting section 571 which sets an intermediate outer perimeter frame F3 (frame shown with a solid line in FIG. 34A and FIG. 34B) with the average value as the coordinate value.

Then, the design image reducing section 57 reduces the print design image G to a size within the intermediate outer perimeter frame F3 set by the intermediate outer perimeter frame setting section 571.

When all of the design elements dp included in the print design image G are contained within the nail region Ta as a result of reduction by the design image reducing section 57 (for example, as shown in FIG. 34B), the image data of the reduced print design image G is used as the print data for printing on the nail region Ta.

When all of the design elements dp included in the print design image G are not contained within the nail region Ta even if the print design image G is reduced to the size within the intermediate outer perimeter frame F3, the design image reducing section 57 further reduces the print design image G to the same size as the adjusted outer perimeter frame F2 (frame shown with an alternate long and two dashes line in FIG. 34A).

Here, when the nail region Ta has a shape where a portion is dented as shown in FIG. 35A and FIG. 35B, even when the print design image G is reduced to a size within the intermediate outer perimeter frame F3 (within a frame shown with a solid line in FIG. 35A and FIG. 35B), a portion of the design elements dp (in FIG. 35A, a portion of the left side of the design element dp2) may be outside of the nail region Ta.

In this case, as shown in FIG. 35B, the print design image G is moved in a vertical direction (y-axis direction) while reducing the print design image G to a size the same as the size of the outer perimeter frame F2 (frame shown with an alternate long and two dashes line in FIG. 35B) after adjustment by the outer perimeter frame adjusting section 563.

In this case, the print design image G reduced to a size the same as the adjusted outer perimeter frame F2 is the print data.

When the size and the printing position of the print design image G is set to the size and the position shown in FIG. 35B and printing is performed, the image shown in FIG. 36 is printed on the nail region Ta.

With this, even when the nail region Ta is a particular shape such as a shape where a portion is dented, all of the design elements dp can be secured within the nail region Ta and the entire design can be printed on the nail region Ta without a portion of the design lacking.

The main body control section 52 functions as a display control section which displays on the display section 13 an image in which the print data is overlapped with the nail region Ta of the finger image of the user as a design confirming screen 132.

Next, the print control method of the nail print apparatus 1 of the present embodiment is described with reference to FIG. 15 to FIG. 36.

Figure 15:
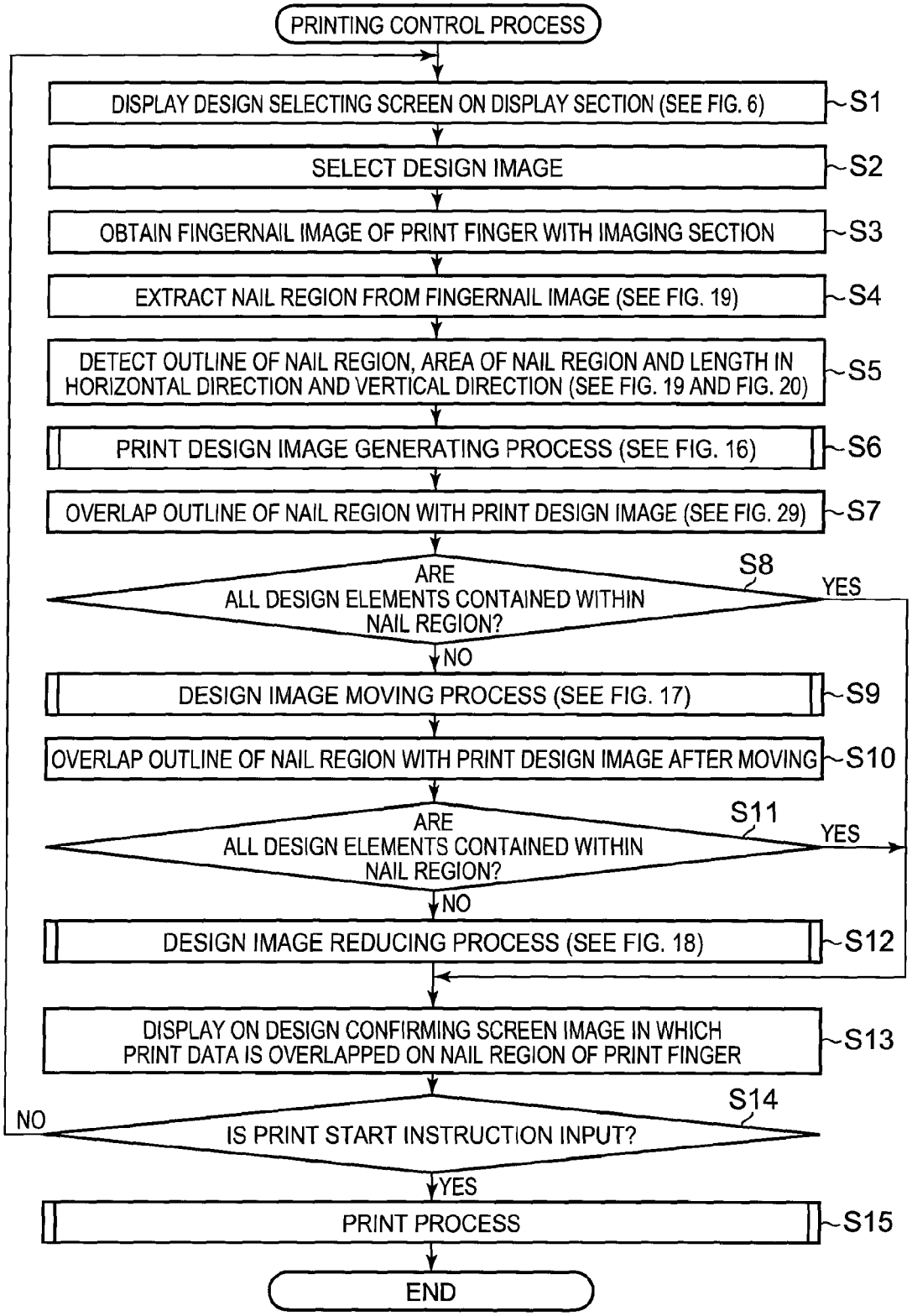
FIG. 15 is a flowchart showing printing control process of the present embodiment.

FIG. 15 is a flowchart showing printing control process of the present embodiment.

Figure 16:
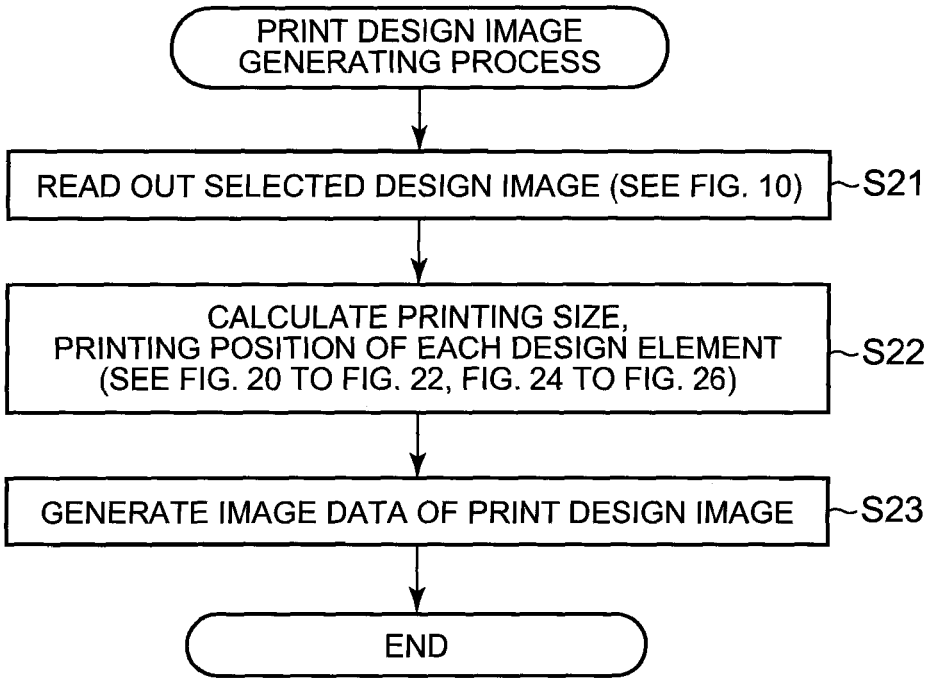
FIG. 16 is a flowchart specifically showing a content of print design image generating process shown in FIG. 15.

FIG. 16 is a flowchart specifically showing a content of print design image generating process shown in FIG. 15.

Figure 17:
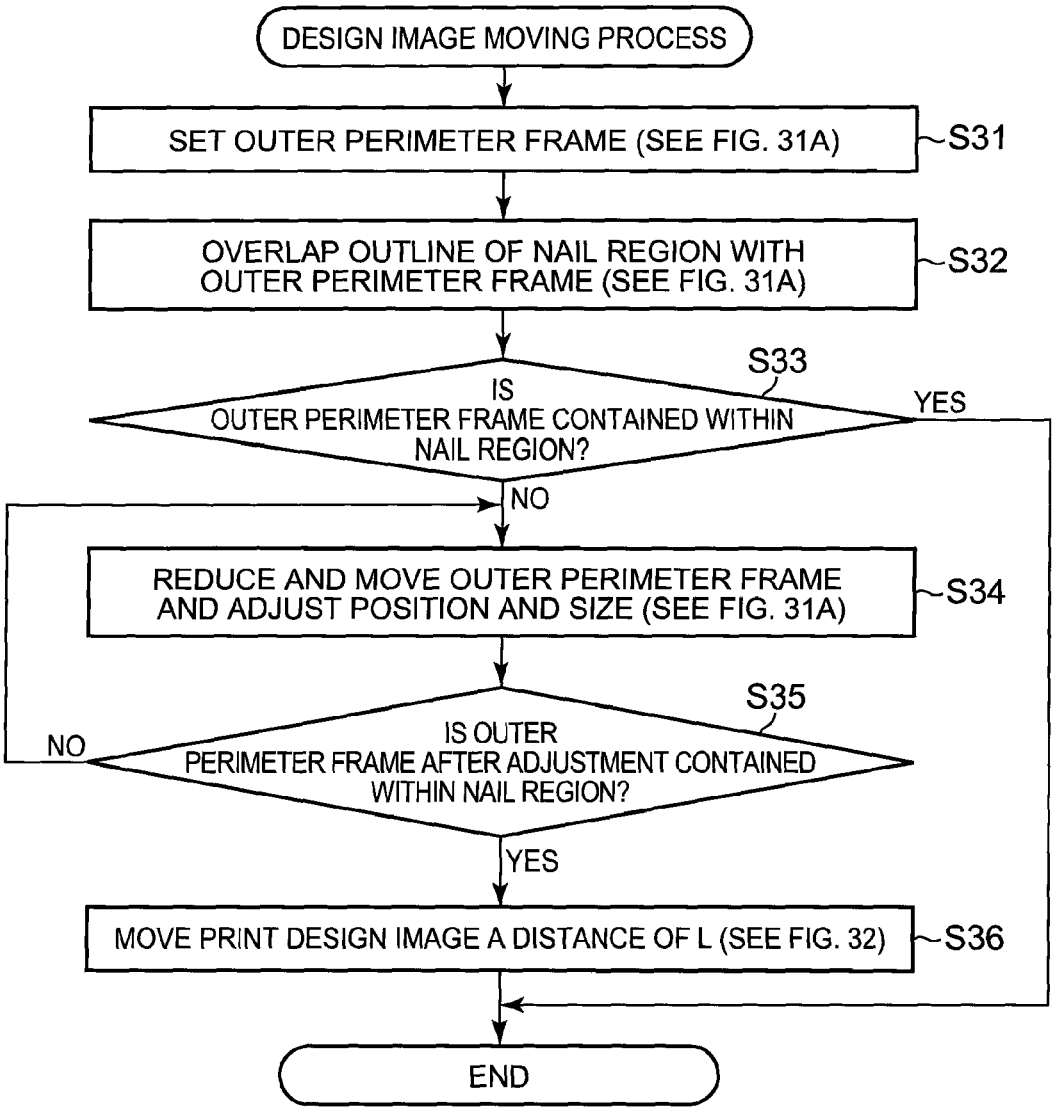
FIG. 17 is a flowchart specifically showing a content of design moving process shown in FIG. 15.

FIG. 17 is a flowchart specifically showing a content of design moving process shown in FIG. 15.

Figure 18:
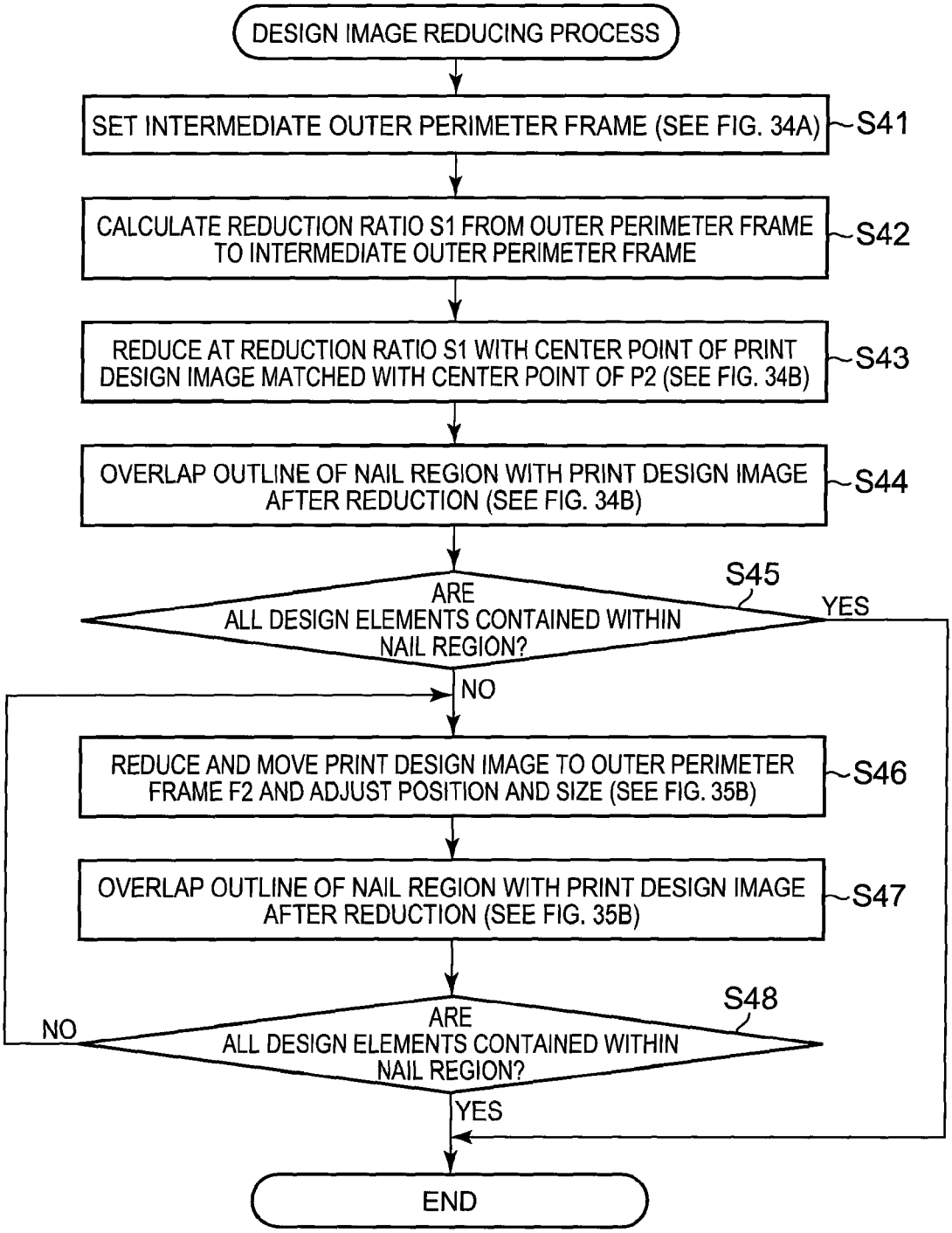
FIG. 18 is a flowchart specifically showing a content of design reducing process shown in FIG. 15.

FIG. 18 is a flowchart specifically showing a content of design reducing process shown in FIG. 15.

When the printing with the nail print apparatus 1 is performed, first the user turns the power switch to ON and starts the control device 50.

As shown in FIG. 15, the main body control section 52 displays the design selecting screen 131 (see FIG. 6) on the display section 13 (step S1).

The user operates the operating buttons 121, etc. of the operating section 12 to select a desired design image from the plurality of design images displayed on the design selecting screen 131. With this, the selection instruction signal is output from the operating section 12 and a design image is selected (step S2).

Next, the user inserts the print finger U1 in the print finger inserting section 20*a*, inserts the non-print finger U2 in the non-print finger inserting section 20*b*, fixes the print finger U1 and operates the printing switch.

For example, when the user desires to print on the nail region Ta of the index finger, the middle finger, the ring finger, and the little finger of the left hand, as shown in FIG. 3, the user inserts the index finger, the middle finger, the ring finger and the little finger in the print finger inserting section 20*a* aligned in a planar state and inserts the thumb in the non-print finger inserting section 20*b*.

The holding section 20*c* is held between the index finger, the middle finger, the ring finger and the little finger inserted in the print finger inserting section 20*a* and the thumb inserted in the non-print finger inserting section 20*b*. With this, the index finger, the middle finger, the ring finger, and the little finger which are the print fingers U1 are fixed on the holding section 20*c*.

When an instruction is input from the printing switch of the display section 13, the control device 50 first controls the imaging section 30 and photographs the entire print finger U1 before starting the printing operation. With this, the finger image of the print finger U1 is obtained (step S3).

The nail region information detecting section 53 extracts the nail region Ta of the print target region from the finger image (see step S4, FIG. 19).

Then, the nail region information detecting section 53 detects the outline Tac, the area (S), the length in the horizontal direction (x-axis direction) (W), and the length in the vertical direction (y-axis direction) (H) of the nail region Ta (step S5).

The detected result of the nail region information detecting section 53 is sent to the nail region data storing section 512 of the storage section 51 and stored (see FIG. 20).

Next, the print design image generating section 54 performs generating process of the print design image G (step S6). As shown in FIG. 16, the element layout calculating section 541 of the print design image generating section 54 reads out the data (see FIG. 10) of the design element dp included in the design image selected in step S2 in FIG. 15 from the design data storing section 511 (step S21).

Then, the element layout calculating section 541 calculates the printing size and the printing position of each design element dp based on the read out design image including the size data and the position data of two positions of each design element dp and the above described area and length in the horizontal direction and the vertical direction of the nail region Ta of the print finger U1 of the user detected by the nail region information detecting section 53 (see step S22, FIG. 20 to FIG. 22, FIG. 24 to FIG. 26).

Then, the print design image generating section 54 generates a print design image G in which each design element dp is positioned in a printing size and printing position to match with the area and the length in the horizontal direction and the vertical direction of the nail region Ta of the user based on the printing size and the printing position of each design element dp calculated by the element layout calculating section 541 and the picture data of each design element dp (step S23).

The print design image G generated by the print design image generating section 54 is stored in the print design image storing section 513 of the storage section 51.

Returning to FIG. 15, when the print design image G is generated, as shown in FIG. 29, the element position judging section 55 overlaps the outline Tac of the nail region Ta detected by the nail region information detecting section 53 (shown with a broken line in FIG. 29) with a print design image G generated by the print design image generating section 54 (step S7).

Then, the element position judging section 55 sequentially scans from a predetermined position such as the upper left edge section, etc. of the image, compares the coordinate value of the design element dp included in the image data of the print design image G with the coordinate value of the outline Tac of the nail region Ta and judges whether or not all of the design elements dp are contained within the nail region Ta (step S8).

When the element position judging section 55 judges that all of the design elements dp of the print design image G are contained within the nail region Ta (step S8; YES), the image data of the print design image G is stored in the storage section 51 as print data.

When the element position judging section 55 judges that all of the design elements dp included in the image data of the print design image G are not contained within the nail region Ta (step S8; NO), then, design image moving process (step S9) is performed to move the print design image G. When the element position judging section 55 judges that at least a portion of the design element dp is not contained within the nail region Ta (step S8 in FIG. 15; NO), as shown in FIG. 17, the outer perimeter setting section 561 of the design image moving section 56 sets the outer perimeter frame F1 which is the frame which draws the outer perimeter of the print design image G (step S31).

Next, as shown in FIG. 31A, the outer perimeter frame position judging section 562 overlaps the outer perimeter frame F1 (shown with a solid line in FIG. 31A) obtained by the outer perimeter frame setting section 561 with the outline Tac (shown with a broken line in FIG. 31A) of the nail region Ta detected by the nail region information detecting section 53 (step S32).

Then, the outer perimeter frame position judging section 562 sequentially scans from the predetermined position (for example, sequential scanning from the top line of the image one line at a time from left to right).

Then, the outer perimeter frame position judging section 562 judges whether or not the coordinate value of the outer perimeter frame F1 is contained within the inside of the coordinate value of the outline of the nail region Ta (in other words, within the range of the nail region Ta) (step S33).

When the outer perimeter frame position judging section 562 judges that the outer perimeter frame F1 is not contained within the nail region Ta (step S33; NO), first the outer perimeter frame adjusting section 563 moves the outer perimeter frame F1 up and down in the y-axis direction while reducing so that the outer perimeter frame F1 is contained within the nail region Ta and adjusts the position and the size (step S34). Here, the outer perimeter frame adjusting section 563 reduces the outer perimeter frame F1 while maintaining the aspect ratio of the outer perimeter frame F1.

When the outer perimeter frame adjusting section 563 performs adjustment, the outer perimeter frame position judging section 562 scans the adjusted outer perimeter frame F2 in a state overlapped with the nail region Ta and judges whether or not the adjusted outer perimeter frame F2 is contained within the nail region Ta (step S35).

When the outer perimeter frame position judging section 562 judges that the outer perimeter frame F2 after adjustment by the outer perimeter frame adjusting section 563 is contained within the nail region Ta (step S35; YES), the design image moving section 56 moves the print design image G in the vertical direction (y-axis direction) in a distance L between the center point P1 and the center point P2 so that the center point P1 is in a position which matches with the center point P2 of the outer perimeter frame after adjustment by the outer perimeter frame adjusting section (step S36).

When the outer perimeter frame position judging section 562 judges that the outer perimeter frame F2 after adjustment by the outer perimeter frame adjusting section 563 is not contained within the nail region Ta (step S35; NO), the process returns to step S34, and the process is repeated until the outer perimeter frame position judging section 562 judges that the outer perimeter frame F2 is contained within the nail region Ta.

Returning to FIG. 15, when the design image moving section 56 moves the print design image G (step S36 in FIG. 17), as shown in FIG. 15, the element position judging section 55 overlaps the outline Tac (shown with a broken line in FIG. 32) of the nail region Ta detected by the nail region information detecting section 53 with the print design image G after moving by the design image moving section 56 (step S10).

Then, the element position judging section 55 sequentially scans from a predetermined position such as the upper left edge section of the image, compares the coordinate value of the design element dp included in the image data of the print design image G with the coordinate value of the outline Tac of the nail region Ta and judges whether or not all of the design elements dp are contained within the nail region Ta (step S11).

Then, when the element position judging section 55 judges that all of the design elements dp of the print design image G after moving are contained within the nail region Ta (step S11; YES), the image data of the print design image G after moving is stored as the print data in the storage section 15.

When the element position judging section 55 judges that at least a portion of the design element dp included in the image data of the print design image G after moving is not contained within the nail region Ta (step S11; NO), next, design image reducing process (step S12) to reduce the print design image G is performed.

When the element position judging section 55 judges that at least a portion of the design element dp is not contained within the nail region Ta (step S11 in FIG. 15; NO), as shown in FIG. 18, the intermediate outer perimeter frame setting section 571 of the design image reducing section 57 calculates the average value of the corresponding coordinates between the coordinate values of the outer perimeter frame F2 after adjustment by the outer perimeter frame adjusting section 563 (frame shown with an alternate long and two short dashes line in FIG. 34A) and the coordinate values of the outer perimeter frame F1 before adjustment (frame shown with a broken line in FIG. 34A and FIG. 34B) and sets an intermediate outer perimeter frame F3 (frame shown with a solid line in FIG. 34A and FIG. 34B) in which the average values are the coordinate values (step S41).

Then, the design image reducing section 57 first calculates the reduction ratio S1 from the outer perimeter frame F1 before adjustment by the outer perimeter frame adjusting section 563 to the intermediate outer perimeter frame F3 (step S42).

Then, the design image reducing section 57 reduces the print design image G at a reduction ratio of S1 with the center point of the print design image G matching the center point P2 of the outer perimeter frame F2 moved by the design image moving section 56 (step S43).

When the design image reducing section 57 reduces the print design image G at a reduction ratio of S1, the element position judging section 55 overlaps the outline Tac (shown with a broken line in FIG. 34B) of the nail region Ta detected by the nail region information detecting section 53 with the print design image G after reduction by the design image reducing section 57 (step S44).

Then, when the element position judging section 55 sequentially scans the image from a predetermined position such as the top left edge section of the image, the element position judging section 55 compares the coordinate value of the design element dp included in the image data of the print design image G after reduction with the coordinate value of the outline Tac of the nail region Ta and judges whether or not all of the design elements dp are contained within the nail region Ta (step S45).

Then, when the element position judging section 55 judges that all of the design elements dp of the print design image G after reduction are contained within the nail region Ta (step S45; YES, see for example FIG. 34B), the image data of the print design image G after reduction is stored in the storage section 51 as print data and the design image reducing process ends.

When the element position judging section 55 judges that at least one portion of the design element dp is not contained within the nail region Ta (step S45; NO, for example, see FIG. 35A), the design image reducing section 57 moves the print design image G in the y-axis direction while reducing the print design image G to the size of the outer perimeter frame F2 after adjustment by the outer perimeter frame adjusting section 563 (step S46).

The element position judging section 55 overlaps the outline Tac (shown with a broken line in FIG. 35A and FIG. 35B) of the nail region Ta detected by the nail region information detecting section 53 with the print design image G after reduction by the design image reducing section 57 (step S47).

Then, the element position judging section 55 sequentially scans the image from a predetermined position such as the top left edge section, compares the coordinate value of the design element dp included in the image data of the reduced print design image G with the coordinate value of the outline Tac of the nail region Ta and judges whether or not all of the design elements dp are contained within the nail region Ta (step S48).

When the element position judging section 55 judges that at least a portion of the design element dp of the print design image G after reduction is not contained within the nail region Ta (step S48; NO), the process returns to step S46 and the process is repeated.

When the element position judging section 55 judges that all of the design elements dp of the print design image G after reduction are contained within the nail region Ta (step S48: YES), the image data of the print design image G after reduction is stored in the storage section 51 as print data and the design image reducing process ends.

Returning to FIG. 15, when the element position judging section 55 judges that all of the design elements dp of the print design image G generated by the print design image generating section 54 are contained within the nail region Ta (step S8; YES), when the element position judging section 55 judges that all of the design elements dp of the print design image G after moving by the design image moving section 56 are contained within the nail region Ta (step S11; YES), and when the element position judging section 55 judges that all of the design elements dp of the print design image G after reduction by the design image reducing section 57 are contained within the nail region Ta (step S48 shown in FIG. 18; YES), the print data stored in the storage section 51 is output to the main body control section 52 and the main body control section 52 displays on the display section 13 the image of the print data overlapped on the nail region Ta of the finger image of the user as the design confirming screen 132 (see FIG. 7) (step S13).

The user confirms the final print image by looking at the design confirming screen 132 and when the user is satisfied to allow printing with the print image, the user operates the operating button 121 such as the OK button, etc. of the operating section 12 and inputs the print start instruction.

The main body control section 52 judges whether or not a print start instruction is input (step S14) and when the main body control section 52 judges that a print start instruction is input (step S14; YES), the print data is output to the printing section 40 and the main body control section 52 controls the printing section 40 to perform printing on the nail region Ta according to the print data.

With this, the printing process by the printing section 40 is started (step S15).

When the user does not operate the OK button, etc. and the main body control section 52 judges that the print start instruction is not input (step S14; NO), the main body control section 52 returns to step S1, displays the design selecting screen 131 again on the display section 13 and repeats the process.

Here, process of one print finger U1 is described. When printing process is performed together on a plurality of print fingers U1 such as four fingers as described in the present embodiment, the above process is repeated on each finger of the print fingers U1 to perform printing process on all print fingers U1.

As described above, according to the nail print apparatus 1 of the present embodiment, the image data of the print design image G is generated based on the image data of the design image and the size of the nail region Ta of the user, it is judged whether or not all of the design elements dp included in the image data of the print design image G are contained within the nail region Ta and when at least a portion of the design element dp is not contained within the nail region Ta, the print design image G is moved so that all of the design elements dp are contained within the nail region Ta.

Therefore, when the size, etc. of the design image is adjusted according to the size of the nail region Ta of the user, it is possible to prevent the deforming of the shape of each design element, the changing of the position relation between the design elements, and the changing of the position relation between the design element and the edge section of the nail region, and the design image selected by the user can be printed in a shape close to the impression in a size as large as possible on the nail region Ta of the user.

It is judged whether or not the design element dp is contained within the nail region Ta when the print design image G is moved, and when the design element dp is not contained within the nail region Ta, the print design image G is reduced. Therefore, as shown in FIG. 37A to FIG. 37F, a design of the design image selected by the user can be printed close to the impression in a size as large as possible and balanced on various shapes of the nail region Ta.

When it is judged that at least a portion of the design element dp is not contained within the nail region Ta, the outer perimeter frame F1 of the print design image G is set and the print design image G is moved in the amount of the difference between the outer perimeter frame F2 after adjustment of adjusting the outer perimeter frame F1 to be contained within the nail region and the outer perimeter frame F1 before adjustment.

Therefore, the position of the print design image G does not drastically change and the adjustment can be performed while maintaining the impression as close as possible to the design image selected by the user.

According to the present embodiment, the element position judging section 55 judges whether or not all of the design elements dp are contained within the nail region Ta after moving the print design image G and when at least a portion of the design element dp is not contained within the nail region Ta, the print design image G is reduced. Therefore, when the design elements dp are contained within the nail region Ta by simply moving the print design image G, the design can be printed in the original size without reducing and the design image can be printed in a size as large as possible.

The design image reducing section 57 reduces the print design image at a ratio according to the reduction ratio of the outer perimeter frame F2 after adjustment with respect to the outer perimeter frame F1 before adjustment, and therefore, it is possible to prevent reducing the print design image G too much and the design image can be printed as large as possible.

The design image reducing section 57 calculates the average value of the corresponding coordinates between the coordinate value of the adjusted outer perimeter frame F2 and the coordinate value of the outer perimeter frame F1 before adjustment, sets the intermediate outer perimeter frame F3 in which the coordinate value is the average value and reduces the print design image to the size within the intermediate outer perimeter frame F3. When the image is not contained within the intermediate outer perimeter frame F3, the print design image is reduced to the size within the outer perimeter frame F2 after adjustment. Therefore, it is possible to prevent reducing the print design image G too much and the design image can be printed as large as possible.

The data of the design image printed on the nail region Ta includes a plurality of design elements dp and the design elements dp are stored in the design data storing section 511 corresponded with the size data, the position data, and the picture data for each design element dp, and the printing size and the printing position for each design element dp can be calculated when the size and the shape of the design image is adjusted according to the area and shape of the nail region Ta of the user (for example the length in the vertical direction being long (see FIG. 23), the width in the horizontal direction being wide (see FIG. 26), etc.).

Therefore, different from when the entire design image is stored as one piece of data and the print data is generated by changing the reduction ratio of the entire design image, it is possible to prevent the deforming of the shape of each design element dp, the changing of the position relation between the design elements dp, and the changing of the position relation between the design element dp and the edge section of the nail region Ta and it is possible to print on the nail region Ta of the user the design image selected by the user with the design selecting screen 131 as close as possible to the impression of the design image.

The size data of each design element dp specifies the size of each design element dp with a relative area ratio between the area of each design element dp and the area of the standard nail model Tv when the design image is positioned on the standard nail model Tv. The position data of the design element dp specifies the position of each design element dp with the relative position relation when the length in the horizontal direction and the length in the vertical direction of the standard nail model Tv are the standard. With this, the element layout calculating section 541 replaces the area and the length in the horizontal direction and the vertical direction of the standard nail model Tv with the area S, the length in the horizontal direction W and the length in the vertical direction H of the nail region Ta of the user detected by the nail region information detecting section 53 and calculates the printing size and the printing position of the design element dp. Therefore, no matter what area or what shape the nail region Ta has, the printing size and the printing position of the design elements dp can be easily calculated by calculating the area ratio and the relative position of the design element dp with respect to the nail region Ta.

The present embodiment describes an example where the print design image G is moved in the vertical direction (y-axis direction) when the element position judging section 55 judges that at least a portion of the design element dp is outside the nail region Ta when the print design image G is overlapped on the nail region Ta of the user. However, the direction that the print design image G is moved is not limited to the vertical direction (y-axis direction).

For example, the print design image G can be moved in the x-axis direction while reducing. Instead of the vertical direction (y-axis direction), the print design image G can be moved in a diagonal direction while reducing. The print design image G can be reduced while moving in both the x-axis direction and the y-axis direction as necessary.

Such adjustment is effective because it may be easier to adjust the print design image G within the nail region Ta by moving in the x-axis direction or the diagonal direction depending on the shape of the nail region Ta or the selected design image.

The present embodiment describes an example of adjusting the position and the size of the outer perimeter frame F1 by moving the outer perimeter frame F1 up and down along the y-axis direction while reducing when the outer perimeter adjusting section 563 adjusts the outer perimeter frame F1. However, the adjustment of the outer perimeter frame F1 of the outer perimeter frame adjusting section 563 is not limited to the above and the outer perimeter frame F1 can be adjusted by moving in the x-axis direction or a diagonal direction.

Figure 38A:
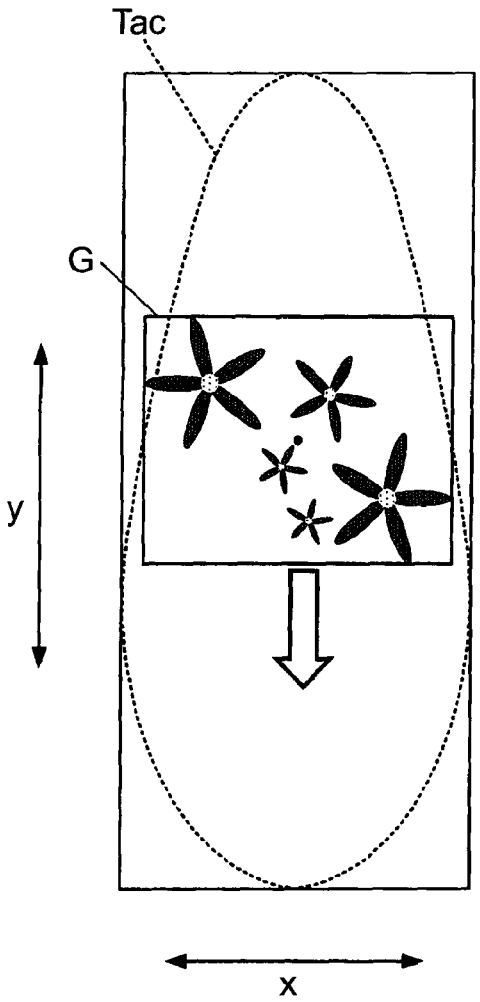
FIG. 38A is a diagram showing a state where the design element of a portion of the print design image is outside the nail region.
Figure 38B:
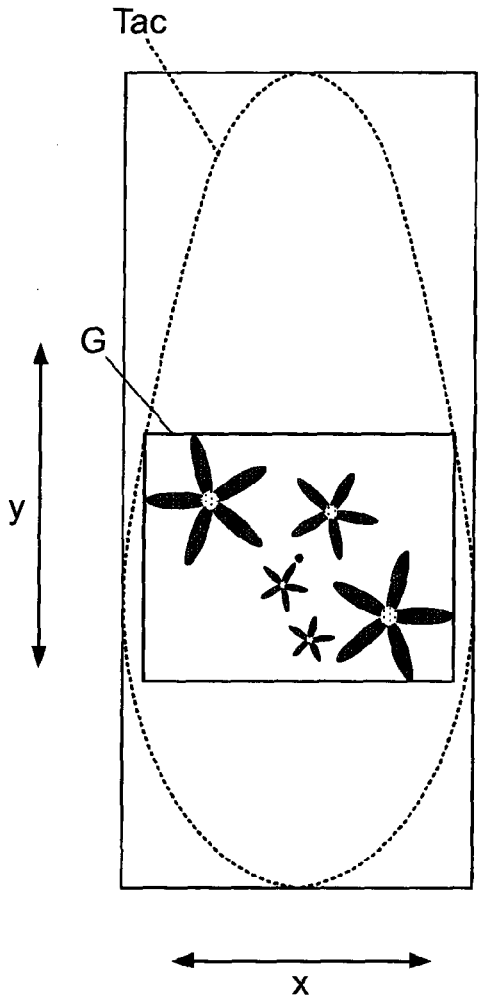
FIG. 38B is a diagram showing a state where all of the design elements are contained within the nail region by simply moving the print design image shown in FIG. 38A.

FIG. 38A shows a diagram where a design element of a portion of the print design image is outside the nail region and FIG. 38B shows a diagram where all of the design elements are contained within the nail region by simply moving the print design image shown in FIG. 38A.

For example, as shown in FIG. 38A and FIG. 38B, when only the top portion of the nail region Ta is narrow, a portion of the design element dp included in the design image is outside the nail region Ta with the original position based on the result calculated with the element layout calculating section 541. However, when the print design image G is moved in the vertical direction (down direction in FIG. 38A) along the y-axis, all of the design elements dp may be contained within the nail region Ta by simply moving the print design image G.

Therefore, in such case, as shown in FIG. 38B, the design image moving section 56 can perform adjustment by simply moving the print design image G without reducing.

The present embodiment describes an example of adjusting the position and the size of the outer perimeter frame F1 while moving and reducing the outer perimeter frame F1 when the outer perimeter frame adjusting section 563 adjusts the outer perimeter frame F1. However, adjustment can be performed without reducing when the outer perimeter frame F1 is positioned within the nail region Ta by simply moving the outer perimeter frame F1.

The present embodiment describes moving the print design image G with the design element dp which the element position judging section 55 first judges to be outside the nail region Ta as the standard when the print design image G is overlapped with the nail region Ta of the user. However, the standard used in adjusting the outer perimeter frame F1 and moving the print design image G is not limited to the design element dp first judged to be outside the nail region Ta.

For example, the design element dp which is outside the nail region Ta the most after scanning the entire image can be considered to be the standard. Weighting can be provided in advance for each design element dp of the design image and the design element dp outside the nail region Ta among the weighted design elements dp can be considered to be the standard.

When a plurality of design elements dp are outside the nail region Ta, the design element dp to be used as the standard for moving the print design image G is not limited, and the design element dp which the element position judging section 55 first judges to be outside the nail region Ta can be used as the standard. The design element dp which is displaced most outside of the nail region Ta can be used as the standard. Process can be sequentially performed on the design element dp judged to be outside the nail region Ta by repeating the similar process.

In the present embodiment, the position of each design element dp in the horizontal direction (x-axis direction) is a relative position shown by setting a standard frame Fr surrounding the top, bottom, left, and right of the standard nail model Tv (or nail region Ta), then setting the position where the center of the design element dp is positioned as 0% when the design element dp is positioned on the standard nail model Tv (or the nail region Ta) in a position that the left edge overlaps with the left side of the standard frame Fr of the standard nail model Tv and setting the position where the center of the design element dp is positioned as 100% when the design element dp is positioned on the standard nail model Tv (or the nail region Ta) in a position that the right edge overlaps with the right side of the standard frame Fr of the standard nail model Tv (or the nail region Ta).

However, how to determine the position of 0% and the position of 100% which is to be the standard of determining the position of each design element dp in the horizontal direction (x-axis direction) is not limited to the illustrated examples.

For example, 0% can be the position where the left edge of the design element dp is positioned when the design element dp is positioned on the standard nail model Tv (or the nail region Ta) in a position that the left edge overlaps with the left side of the frame of the standard nail model Tv (or the nail region Ta) and 100% can be the position where the right edge of the design element dp is positioned when the design element dp is positioned on the standard nail model Tv (or the nail region Ta) in a position that the right edge overlaps with the right side of the frame of the standard nail model Tv (or the nail region Ta).

The same can be said for determining the position of 0% and the position of 100% which is the standard for determining the position of each design element dp in the vertical direction (y-axis direction).

In the present embodiment, the area (S) represented as a number of dots, and the length (W) in the horizontal direction (x-axis direction) and the length (H) in the vertical direction (y-axis direction) represented by a number of dots are stored as data of the nail region Ta. However, the method of storing the data of the area (S), the length (W) in the horizontal direction (x-axis direction) and the length (H) in the vertical direction (y-axis direction) is not limited to representing the data by the number of dots.

According to the present embodiment, the design data storing section 511 and the nail region data storing section 512 are provided in the storage section 51 of the control device 50. However, the invention is not limited to providing the design data storing section 511 and the nail region data storing section 512 in the storage section 51 of the control device 50 and a separate storage section can be provided.

The present embodiment describes a nail print apparatus 1 which can print on four fingers at the same time, however, the present invention can be applied to an apparatus where the finger is inserted in the apparatus one finger at a time and printing is sequentially performed.

The present invention is not limited to the present embodiment and can be suitably modified.

A plurality of embodiments of the present invention have been shown and described, however the scope of the present invention is not limited to the above described embodiments and include the scope as described in the claims and its equivalents.

What is claimed is:

1. A nail print apparatus which prints on a nail comprising:

an imaging section which obtains a finger image by photographing a finger including the nail;

a nail region information detecting section which extracts a nail region corresponding to a surface of the nail from the finger image and detects a coordinate value of an outline of the nail region and an area of the nail region;

a print design image generating section which generates a print design image in which at least one design element is positioned in a region including the nail region based on a specific design image;

an element position judging section which judges whether or not the design element of the print design image is contained within the nail region;

a design image adjusting section which adjusts at least one of a position of the print design image with respect to the nail region and a size of the print design image; and a printing section which includes a printing head to apply ink to the nail based on the print design image;

wherein:

the design element is set in a certain figure;

the specific design image is an image which includes the design element positioned on a pre-set shaped standard nail model;

the print design image generating section sets (i) a standard frame including sides which come into contact with an outline of the standard nail model, the sides of the standard frame extending along a first direction and a second direction which intersects with the first direction, and (ii) a nail region frame including sides which come into contact with an outline of the nail region, the sides of the nail region frame extending along the first direction and the second direction;

the print design image generating section sets a center position of the design element in the first direction in the print design image in a position in proportion with a center position of the design element in the first direction in the specific design image;

the print design image generating section sets a center position of the design element in the second direction in the print design image in a position in proportion with a center position of the design element in the second direction in the specific design image;

in the print design image, the print design image generating section sets a size of the design element to a value in proportion with a ratio of the area of the nail region with respect to an area of the standard nail model; and the design image adjusting section includes a design image moving section which moves a position of the print design image in the nail region, the design image moving section including:

an outer perimeter frame setting section which sets an outer perimeter frame each side of which is in contact with an outermost edge of the design element of the print design image;

an outer perimeter frame position judging section which judges whether or not the outer perimeter frame is contained within the nail region based on a comparison with a coordinate value of the outer perimeter frame with a coordinate value of the outline of the nail region; and an outer perimeter frame adjusting section which adjusts at least one of the position and the size of the outer perimeter frame when the outer perimeter frame judging section judges that the outer perimeter frame is not contained within the nail region;

wherein the design image moving section moves the print design image to a position where a center point of the print design image matches a center point of the outer perimeter frame after adjustment by the outer perimeter frame adjusting section when the outer perimeter frame position judging section judges that the outer perimeter frame after the adjustment is contained within the nail region.

2. The nail print apparatus according to claim 1, wherein the element position judging section judges whether or not the design element is contained within the nail region based on a comparison with a coordinate value of the design element of the print design image and the coordinate value of the outline of the nail region.

3. The nail print apparatus according to claim 1, wherein the printing section prints, with the printing head, an image based on the print design image adjusted by the design image adjusting section in a position on the nail region adjusted by the design image adjusting section.

4. The nail print apparatus according to claim 1, wherein:

the print design image generating section sets the standard frame in a rectangular shape, wherein the standard frame includes a first side and a second side along the first direction and a third side and a fourth side along the second direction, and wherein the first to fourth sides are in contact with the outline of the standard nail model;

the print design image generating section sets the nail region frame in a rectangular shape, wherein the nail region frame includes a fifth side and a sixth side along the first direction and a seventh side and an eighth side along the second direction, and wherein the fifth to eighth sides are in contact with the outline of the nail region;

the print design image generating section sets a ratio of a length in the first direction from the seventh side to a center position of the design element with respect to a length of the fifth side in the print design image to a same value as a ratio of a length in the first direction from the third side to the center position of the design element with respect to a length of the first side in the specific design image; and the print design image generating section sets a ratio of a length in the second direction from the fifth side to a center position of the design element with respect to a length of the seventh side in the print design image to a same value as a ratio of a length in the second direction from the first side to the center position of the design element with respect to a length of the third side in the specific design image.

5. The nail print apparatus according to claim 4, further comprising:

a design image storage section which stores a plurality of different design images; and a design selecting section to select one of the plurality of design images stored in the design image storage section as the specific design image.

6. The nail print apparatus according to claim 5, wherein:

the nail region information detecting section detects a length of the nail region in the first direction and a length of the nail region in the second direction;

the design image storage section stores size data showing a size of the design element, position data showing a position of the design element in the standard nail model, and picture data corresponding to the design element for each of the plurality of design images; and the print design image generating section includes an element layout calculating section which sets the standard frame and the nail region frame and calculates the size and the position of the design element in the print design image based on the size data and the position data of the design element, the area of the nail region, the length of the nail region in the first direction, and the length of the nail region in the second direction.

7. The nail print apparatus according to claim 1, wherein the outer perimeter frame setting section sets the outer perimeter frame in a rectangular shape with one side along the first direction.

8. The nail print apparatus according to claim 1, wherein:

the design image adjusting section includes a design image reducing section which reduces the print design image;

the element position judging section judges whether or not the design element is contained within the nail region based on a comparison with the coordinate value of the design element included in the image data of the print design image after moving by the design image moving section and the coordinate value of the outline of the nail region; and the design image reducing section reduces the print design image when the element position judging section judges that at least a portion of the design element after moving is not contained within the nail region.

9. The nail print apparatus according to claim 8, wherein the design image reducing section reduces the print design image at a ratio according to a reduction ratio of the outer perimeter frame after adjustment by the outer perimeter frame adjusting section with respect to the outer perimeter frame before adjustment.

10. The nail print apparatus according to claim 8, wherein:

the design image reducing section includes an intermediate outer perimeter frame setting section which calculates an average value between the coordinate value of the outer perimeter frame after adjustment by the outer perimeter frame adjusting section and the coordinate value of the outer perimeter frame before the adjustment and sets an intermediate outer perimeter frame in which a coordinate value of the intermediate outer perimeter frame is the average value; and the design image reducing section reduces the print design image to a size which is contained within the intermediate outer perimeter frame.

11. A printing control method of a nail print apparatus which prints on a nail, the method comprising:

obtaining a finger image by taking a photograph of a finger including the nail;

extracting a nail region corresponding to a surface of the nail from the obtained finger image;

detecting a coordinate value of an outline of the nail region and an area of the nail region;

generating a print design image by positioning at least one design element set in a certain figure in a region including the nail region based on a specific design image which includes the design element positioned on a preset shaped standard nail model;

judging whether or not the design element of the print design image is contained within the nail region; and adjusting at least either one of the position of the print design image with respect to the nail region or the size of the print design image, until it is judged that the design element of the print design image is contained within the nail region;

wherein the generating the print design image includes:

positioning the design element in a position corresponding to a layout position of the design element on the standard nail model in the specific design image and setting a size of the design element to a value in proportion with a ratio of the area of the nail region with respect to an area of the standard nail model;

setting a standard frame including sides which come into contact with an outline of the standard nail model, the sides of the standard frame extending along a first direction and a second direction which intersects with the first direction;

setting a nail region frame including sides which come into contact with the outline of the nail region, the sides of the nail region frame extending along the first direction and the second direction;

setting a center position of the design element in the first direction in the print design image in a position in proportion with a center position of the design element in the first direction in the specific design image; and setting a center position of the design element in the second direction in the print design image in a position in proportion with a center position of the design element in the second direction in the specific design image.

12. The method according to claim 11, further comprising:

after adjusting the print design image so that the design element of the print design image is contained within the nail region, printing an image on the nail region based on the print design image after adjusting.

13. The method according to claim 11, wherein the judging whether or not the design element is contained within the nail region includes comparing a coordinate value of the design element of the print design image with a coordinate value of the outline of the nail region.

14. The method according to claim 11, wherein the generating the print design image includes:

setting the standard frame to include a first side and a second side along the first direction and a third side and a fourth side along the second direction, wherein the first to fourth sides are in contact with the outline of the standard nail model;

setting the nail region frame to include a fifth side and a sixth side along the first direction and a seventh side and an eighth side along the second direction, wherein the fifth to eighth sides are in contact with the outline of the nail region;

setting a ratio of a length in the first direction from the seventh side to a center position of the design element with respect to a length of the fifth side in the print design image to a same value as a ratio of a length in the first direction from the third side to the center position of the design element with respect to a length of the first side in the specific design image; and setting a ratio of a length in the second direction from the fifth side to a center position of the design element with respect to a length of the seventh side in the print design image to a same value as a ratio of a length in the second direction from the first side to the center position of the design element with respect to a length of the third side in the specific design image.

15. The method according to claim 11, wherein the adjusting the design image includes:

setting an outer perimeter frame which has a rectangular shape with one side along the first direction, each side of the rectangular shape being in contact with an outermost edge of the design element of the print design image;

comparing a coordinate value of the outer perimeter frame with a coordinate value of the outline of the nail region to judge whether or not the outer perimeter frame is contained within the nail region; and adjusting at least one of the position and the size of the outer perimeter frame when it is judged that the outer perimeter frame is not contained within the nail region; and moving the print design image to a position where a center point of the print design image matches a center point of the outer perimeter frame after adjusting when it is judged that the outer perimeter frame after adjusting is contained within the nail region.

16. The method according to claim 15, wherein the adjusting the design image includes:

comparing the coordinate value of the design element included in the image data of the print design image after moving with the coordinate value of the outline of the detected nail region to judge whether or not the design element is contained within the nail region; and reducing the print design image at a ratio according to a reduction ratio of the outer perimeter frame after adjusting with respect to the outer perimeter frame before adjusting when it is judged that at least a portion of the design element after moving is not contained within the nail region.

17. The method according to claim 16, wherein the reducing the design image includes:

calculating an average value of a corresponding coordinate between the coordinate value of the outer perimeter frame after adjusting and the coordinate value of the outer perimeter frame before adjusting;

setting an intermediate outer perimeter frame in which a coordinate value of the intermediate outer perimeter frame is the average value; and reducing the print design image to a size which is contained within the intermediate outer perimeter frame.

* * * * *